US010386751B2

(12) United States Patent
Hayashi et al.

(10) Patent No.: US 10,386,751 B2
(45) Date of Patent: Aug. 20, 2019

(54) DEVELOPER CONTAINER, CARTRIDGE, AND IMAGE-FORMING APPARATUS

(71) Applicant: CANON KABUSHIKI KAISHA, Tokyo (JP)

(72) Inventors: Naoki Hayashi, Kawasaki (JP); Shigemi Kamoshida, Susono (JP); Shunsuke Uratani, Mishima (JP); Toshiteru Yamasaki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/607,498

(22) Filed: Jan. 28, 2015

(65) Prior Publication Data

US 2015/0220020 A1 Aug. 6, 2015

(30) Foreign Application Priority Data

Feb. 4, 2014 (JP) ..... 2014-019315

(51) Int. Cl.
*G03G 15/08* (2006.01)

(52) U.S. Cl.
CPC ..... *G03G 15/0881* (2013.01); *G03G 15/0817* (2013.01); *G03G 15/0898* (2013.01)

(58) Field of Classification Search
CPC ..... G03G 15/0874; G03G 15/0817; G03G 15/0898; G03G 21/1648
See application file for complete search history.

(56) References Cited

U.S. PATENT DOCUMENTS

| | | | |
|---|---|---|---|
| 7,110,703 | B2 | 9/2006 | Uratani et al. |
| 7,283,765 | B2 | 10/2007 | Uratani et al. |
| 8,208,830 | B2 | 6/2012 | Uratani et al. |
| 8,422,914 | B2 | 4/2013 | Hayashi et al. |
| 8,571,445 | B2 | 10/2013 | Komatsu et al. |
| 8,755,713 | B2 | 6/2014 | Kawai et al. |
| 8,879,954 | B2 | 11/2014 | Nonaka et al. |
| 8,909,096 | B2 | 12/2014 | Fukui et al. |
| 8,918,011 | B2 | 12/2014 | Yamasaki et al. |
| 8,942,592 | B2 | 1/2015 | Uratani et al. |

(Continued)

FOREIGN PATENT DOCUMENTS

| | | | |
|---|---|---|---|
| JP | H11-167325 | A | 6/1999 |
| JP | 2003-214540 | A | 7/2003 |

(Continued)

OTHER PUBLICATIONS

Sep. 26, 2017 Office Action in Japanese Patent Application No. 2014-019315.

(Continued)

*Primary Examiner* — Victor Verbitsky
(74) *Attorney, Agent, or Firm* — Venable LLP

(57) ABSTRACT

A cleaning unit includes a cleaning frame, a drum, a sheet member coming in contact with a surface of the drum, and an adhesive sealing member compressed between the cleaning frame, the drum, and the sheet member. The cleaning unit includes an end seal portion that is integrally molded with the cleaning frame by injection molding of a resin material, and the end seal portion is compressed and deformed between the cleaning frame and the adhesive sealing member and between the cleaning frame and the sheet member.

22 Claims, 17 Drawing Sheets

(56) References Cited

U.S. PATENT DOCUMENTS

| | | | | |
|---|---|---|---|---|
| 2002/0064392 | A1* | 5/2002 | Miura | G03G 21/1814 399/103 |
| 2009/0245851 | A1 | 10/2009 | Hoshi et al. | |
| 2011/0170903 | A1* | 7/2011 | Hoshi | G03G 15/0898 399/105 |
| 2013/0121720 | A1 | 5/2013 | Hoshi et al. | |
| 2013/0129378 | A1 | 5/2013 | Hoshi et al. | |
| 2013/0209137 | A1 | 8/2013 | Hayashi et al. | |
| 2014/0064776 | A1 | 3/2014 | Yamasaki et al. | |
| 2014/0064784 | A1 | 3/2014 | Hayashi et al. | |
| 2014/0072327 | A1 | 3/2014 | Hayashi et al. | |
| 2014/0086620 | A1 | 3/2014 | Takeuchi et al. | |
| 2014/0112685 | A1 | 4/2014 | Komatsu et al. | |
| 2014/0334844 | A1 | 11/2014 | Fukui et al. | |
| 2014/0376953 | A1 | 12/2014 | Kakuta et al. | |
| 2015/0071679 | A1 | 3/2015 | Yamasaki et al. | |

FOREIGN PATENT DOCUMENTS

| | | | |
|---|---|---|---|
| JP | 2009-265612 | A | 11/2009 |
| JP | 2013-134355 | A | 7/2013 |
| JP | 2013-228633 | A | 11/2013 |
| WO | 2013/069807 | A9 | 5/2013 |

OTHER PUBLICATIONS

Oct. 22, 2018 Office Action in Chinese Patent Application No. 201510054257.X (with English translation).

* cited by examiner

DEVELOPER CONTAINER, CARTRIDGE, AND IMAGE-FORMING APPARATUS

BACKGROUND OF THE INVENTION

Field of the Invention

The present invention relates to a developer container, a cartridge, and an image-forming apparatus.

Description of the Related Art

In an electrophotographic image-forming apparatus (hereinafter, simply referred to as an image-forming apparatus) according to the related art, a cartridge type has been employed in which a photosensitive drum and at least one process means acting on the photosensitive drum are integrally formed in a cartridge and thus the cartridge can be detachably attached to the image-forming apparatus. According to such a cartridge type, since a user can spontaneously perform maintenance of the apparatus, operability can be significantly improved. Therefore, the cartridge type is widely used in the image-forming apparatus.

The cartridge includes a developer receiving portion for accommodating toner as a developer. Then, sealing members are provided at both ends in a rotational axis direction of the photosensitive drum as a rotating member rotatably supported by a frame of the cartridge and prevents the toner from being leaked out of the cartridge.

In addition, a flexible sheet member is provided on the frame so as to contact with an outer periphery along an axial direction of the photosensitive drum and prevents leakage of the developer from a gap formed between the frame and the photosensitive drum.

In the related art, the sealing member and the flexible sheet member were attached to the frame and a filling member was filled in gaps formed between the frame, the sealing member, and the flexible sheet member (Japanese Patent Application Laid-open No. 2003-214540). Thus, the toner is prevented from being flown out of the gaps formed between the frame, the sealing member, and the flexible sheet member.

SUMMARY OF THE INVENTION

A developer container according to the invention includes: a frame that is configured to accommodate a developer; a rotating member that is rotatably supported by the frame; and a sheet member that is attached to the frame so as to come in contact with a surface of the rotating member along a rotational axis direction of the rotating member. The developer container further includes a seal portion that is integrally molded with the frame by injection molding of a resin material into the frame. The developer container is characterized in that the seal portion is compressed and deformed between the frame and the sealing member and between the frame and the sheet member.

In addition, a cartridge according to the invention can be detachably attached to an apparatus main body of an image-forming apparatus in which an image is formed on a recording material and includes a developer container. The developer container includes: a frame that is configured to accommodate a developer; a rotating member that is rotatably supported by the frame; and a sheet member that is attached to the frame so as to come in contact with a surface of the rotating member along a rotational axis direction of the rotating member. The developer container further includes a seal portion that is integrally molded with the frame by injection molding of a resin material into the frame. The cartridge is characterized in that the seal portion is compressed and deformed between the frame and the sealing member and between the frame and the sheet member.

In addition, an image-forming apparatus according to the invention is an image-forming apparatus forming an image on a recording material and includes a developer container. The developer container includes: a frame that is configured to accommodate a developer; a rotating member that is rotatably supported by the frame; and a sheet member that is attached to the frame so as to come in contact with a surface of the rotating member along a rotational axis direction of the rotating member. The developer container further includes a seal portion that is integrally molded with the frame by injection molding of a resin material into the frame. The image-forming apparatus is characterized in that the seal portion is compressed and deformed between the frame and the sealing member and between the frame and the sheet member.

Further features of the present invention will become apparent from the following description of exemplary embodiments with reference to the attached drawings.

DESCRIPTION OF THE EMBODIMENTS

Embodiments of the present invention will be described using examples with reference to the drawings. Dimensions, materials and shapes of the components and relative configurations thereof according to the embodiments should be appropriately changed in accordance with the configuration and various conditions of the apparatus to which the invention is applied. In other words, the following embodiments are not intended to limit the scope of the present invention.

(Embodiment)

<Configuration of Image-forming Apparatus>

Figure 2:
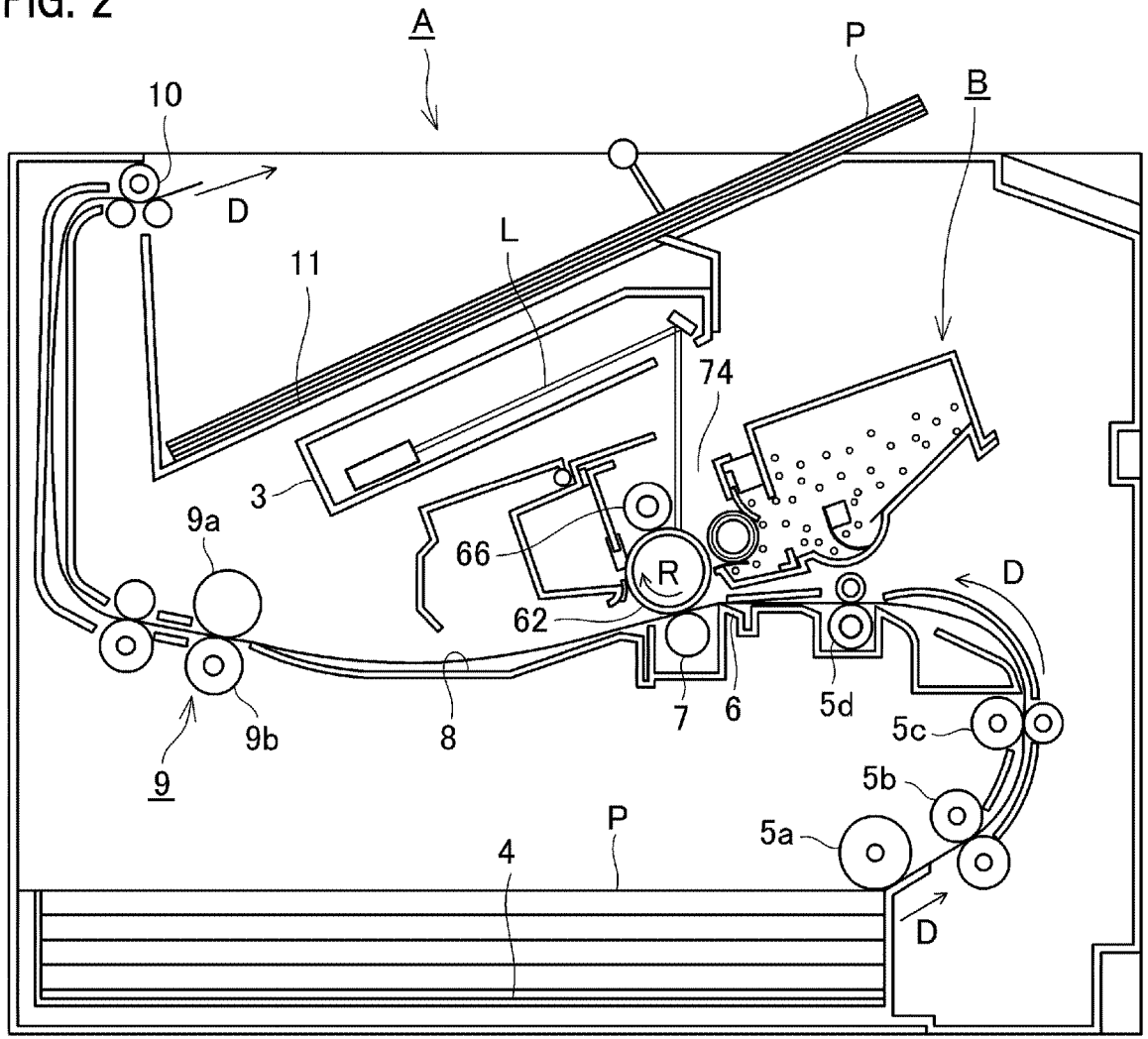
FIG. 2 is a schematically sectional view illustrating an image-forming apparatus according to the present embodiment.
Figure 3:
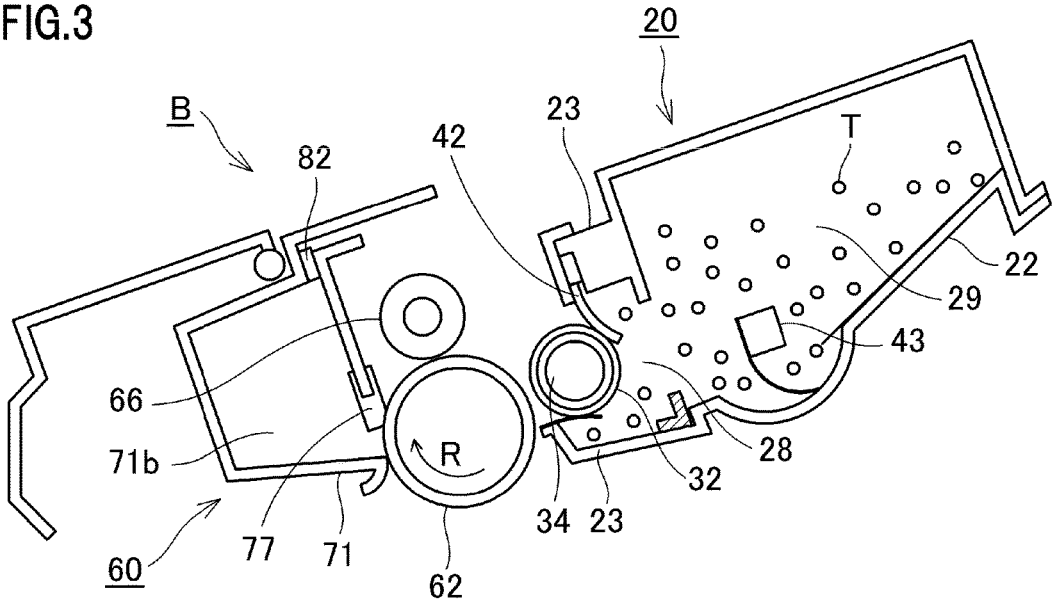
FIG. 3 is a schematically sectional view illustrating a cartridge according to the embodiment.

First, an electrophotographic image-forming apparatus (hereinafter, referred simply to as an image-forming apparatus) according to the embodiment will be described with reference to FIGS. 2 and 3. FIG. 2 is a schematically sectional view illustrating the image-forming apparatus according to the embodiment. FIG. 3 is a schematically sectional view illustrating a cartridge that is detachably provided in the image-forming apparatus according to the embodiment. An apparatus main body A to be described below has a partial configuration of the image-forming apparatus in a state where a cartridge B is excluded therefrom. Moreover, a rotational axis direction of an electrophotographic photosensitive element (hereinafter, referred to as a drum) 62 is a longitudinal direction (direction of an arrow C in FIG. 5). Furthermore, in the longitudinal direction C, a driving side is defined as a side where the drum 62 receives a driving force from the apparatus main body A and a non-driving side is defined as an opposite side thereof.

The image-forming apparatus according to the embodiment is a laser beam printer in which the cartridge B is detachably attached to the apparatus main body A. As illustrated in FIG. 2, when the cartridge B is mounted to the apparatus main body A, a laser scanner unit 3 is disposed above the cartridge B as an exposure device. In addition, a sheet tray 4 is disposed below the cartridge B to accommodate sheet materials P as recording materials on which images are formed.

Furthermore, a pickup roller 5*a*, a pair of feeding rollers 5*b*, a pair of conveying rollers 5*c* and 5*d*, a transfer guide 6, a transfer roller 7, a conveying guide 8, a fixing apparatus 9, a pair of discharge rollers 10, a discharge tray 11 or the like are successively disposed along a conveying direction D of the sheet material P in the apparatus main body A. The fixing apparatus 9 is configured to include a heat roller 9*a* and a pressing roller 9*b*.

<Image Forming Process>

Referring to FIGS. 2 and 3, an image forming process in the image-forming apparatus according to the embodiment will be briefly described below. First, in response to a print starting signal, a drum 62 which is a rotating member (image bearing member) is driven to be rotated at a predetermined circumferential speed (process speed) in a direction indicated by an arrow R. A charging roller 66, to which a bias voltage is applied, comes in contact with an outer peripheral surface of the drum 62 to uniformly charge the outer peripheral surface of the drum 62. The exposure device 3 outputs a laser light L depending on image information. The laser light L passes through an exposure window 74 on an upper surface of the cartridge B and scans and exposes the outer peripheral surface of the drum 62. Therefore, an electrostatic latent image is formed on the outer peripheral surface of the drum 62 in response to the image information.

Meanwhile, as illustrated in FIG. 3, in a developing unit 20 as a developing assembly, a toner T as a developer accommodated in a toner chamber 29 is stirred and conveyed by rotation of a conveying member 43 and is fed to a toner supply chamber 28. The toner T is carried on the developing roller 32 as a developer carrier capable of carrying the toner T on the surface thereof by magnetic force of a magnet roller 34 (fixed magnet). The toner T is applied on a peripheral surface of the developing roller 32 with a regulated layer thickness, while being triboelectrically charged by a developing blade 42. The toner T is transferred onto the drum 62 depending on the electrostatic latent image and thus is visualized as a toner image.

In addition, as illustrated in FIG. 2, in accordance with output timing of the laser light L, the sheet material P accommodated at a lower portion of the apparatus main body A is fed and conveyed from the sheet tray 4 in a direction indicated by an arrow D by the pickup roller 5*a*, the pair of feeding rollers 5*b*, and the pair of conveying rollers 5*c*. Then, the sheet material P is fed to a transfer position between the drum 62 and the transfer roller 7 via the transfer guide 6. In this transfer position, the toner image is successively transferred from the drum 62 onto the sheet material P.

The sheet material P on which the toner image is transferred is separated from the drum 62 and then is conveyed to the fixing apparatus 9 along the conveying guide 8. Then, the sheet material P passes through a nip portion formed between the heat roller 9*a* and the pressing roller 9*b* which constitute the fixing apparatus 9. At this nip portion, pressure and heat fixing process is performed, so that the toner image is fixed on the sheet material P. The sheet material P on which the toner image is fixed is conveyed to the pair of discharge rollers 10 and then is discharged onto the discharge tray 11.

Meanwhile, as illustrated in FIG. 3, residual toner on the outer peripheral surface of the drum 62 is removed by a cleaning blade 77 after the transfer is performed by the transfer roller 7. The removed toner is used again in the image forming process. The toner removed from the drum 62 is stored in a waste toner chamber 71*b* of the cleaning unit 60. In the foregoing, the charging roller 66, the developing roller 32, and the cleaning blade 77 are process means acting on the drum 62.

<Attachment/Detachment of Cartridge>

Figure 4:
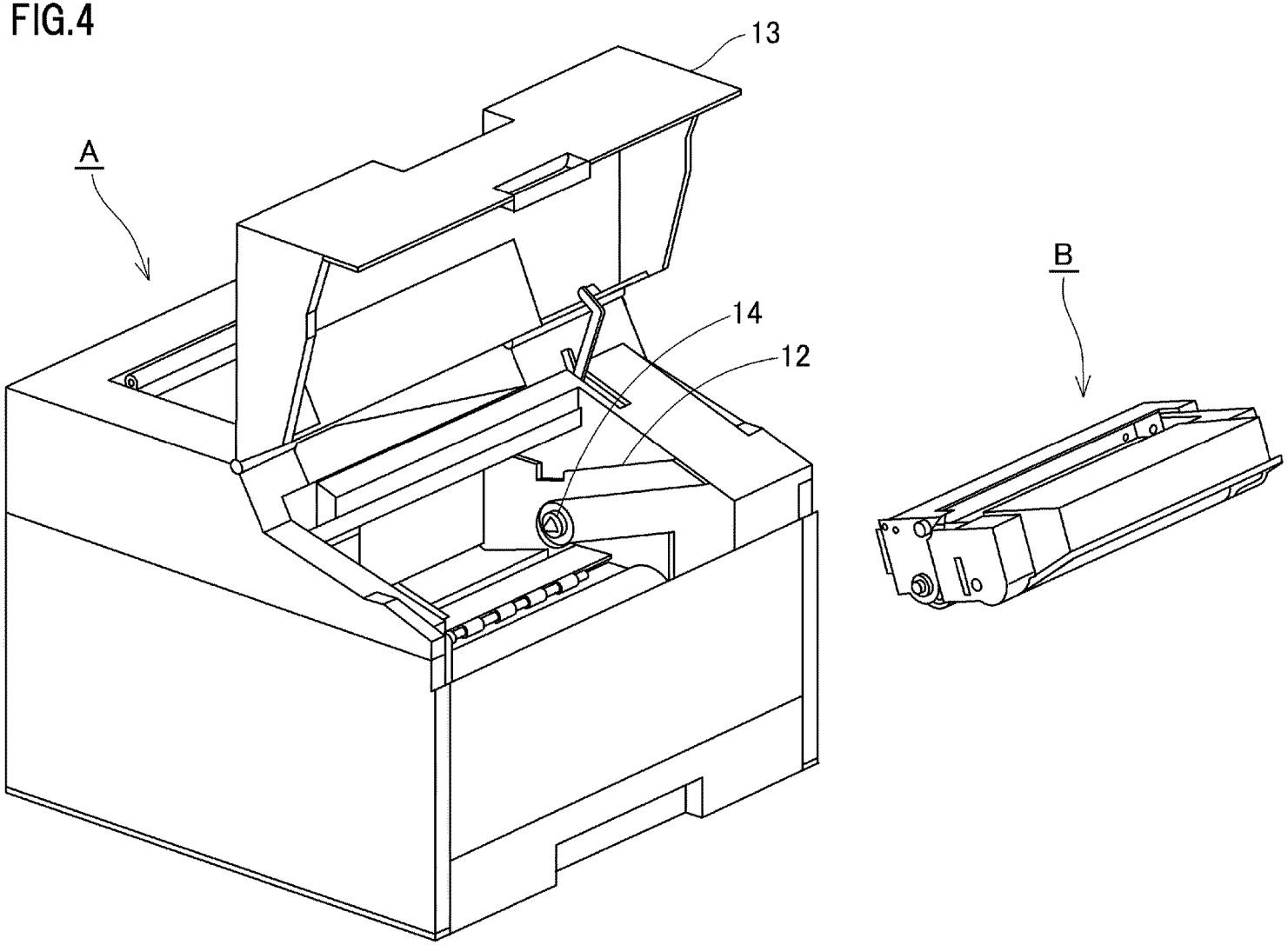
FIG. 4 is a perspective view of an apparatus main body in which an opening/closing door is opened and the cartridge.

An attachment/detachment of the cartridge B with respect to the apparatus main body A will be described below with reference to FIGS. 3 and 4. FIG. 4 is a perspective view of the apparatus main body in which an opening/closing door is opened to attach and detach the cartridge and the cartridge.

An opening/closing door 13 is rotatably attached to the apparatus main body A. In a state where the opening/closing door 13 is opened, the cartridge B is mounted to the apparatus main body A along a guide rail 12 provided in the apparatus main body A. In the attached state where the cartridge B is attached to the apparatus main body A, a driving force receiving portion 63*a* (see FIG. 5) provided in the cartridge B is engaged with a driving shaft 14 to be driven by a motor (not illustrated) provided in the apparatus main body A. The motor is rotated in the state where the driving force receiving portion 63*a* is engaged with the driving shaft 14, and thus the driving force is transmitted to the drum 62 from the driving shaft 14, resulting in rotating the drum 62.

Furthermore, in the attached state where the cartridge B is attached to the apparatus main body A, power is supplied to the charging roller 66 and the developing roller 32 from a power supply portion (not illustrated) provided in the apparatus main body A.

<Schematic Configuration of Cartridge>

Figure 5:
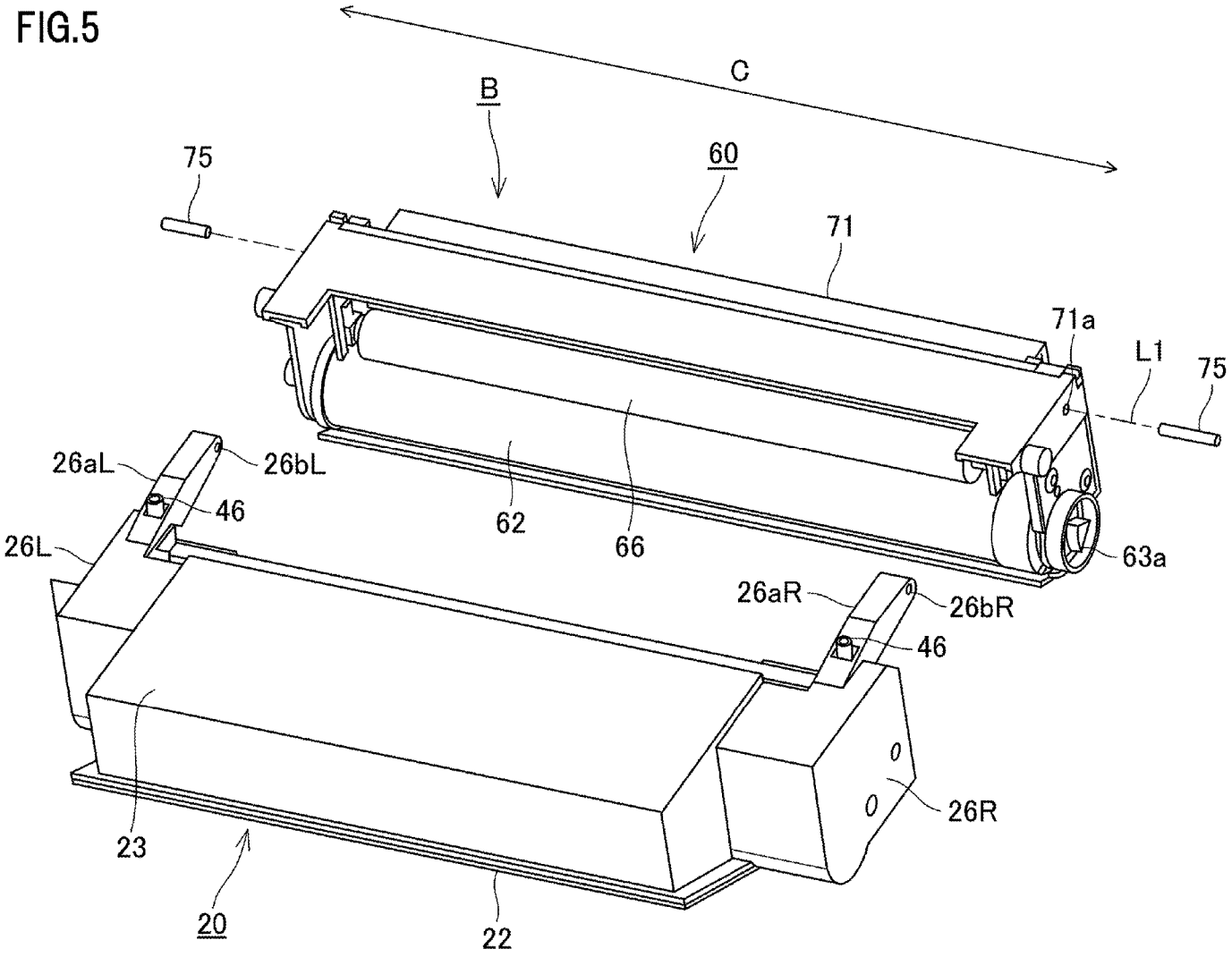
FIG. 5 is a perspective view illustrating the cartridge according to the embodiment.

A schematic configuration of the cartridge will be described below with reference to FIGS. 3 and 5. FIG. 5 is a perspective view illustrating the cartridge and a diagram illustrating a state where the developing unit and the cleaning unit are separated from each other.

The cartridge B is configured by combining the cleaning unit 60 and the developing unit 20. The cleaning unit 60 and the developing unit 20 are rotatably coupled to each other by a coupling member 75.

The cleaning unit 60 mainly includes a cleaning frame 71 as a frame, the drum 62 as a rotating member, the charging roller 66, and the cleaning blade 77. On the other hand, the developing unit 20 mainly includes a developer container 23 for accommodating the toner as a developer, the developing blade 42, the developing roller 32, and the conveying member 43.

Here, the coupling of the cleaning unit 60 and the developing unit 20 will be described in detail. As illustrated in FIG. 5, the developing unit 20 includes a first side member 26L and a second side member 26R at each end in the longitudinal direction C (axial direction of the developing roller 32). A rotation hole 26*b*L extending in the axial direction is provided at a tip of an arm portion 26*a*L formed on the first side member 26L, and a rotation hole 26*b*R extending in the axial direction is provided at a tip of an arm portion 26*a*R formed on the second side member 26R. In addition, as illustrated in FIG. 5, fitting holes 71*a* are provided at both ends of the cleaning frame 71 of the cleaning unit 60.

Then, in a state where the rotation holes 26*b*L and 26*b*R of the developing unit 20 are overlapped with the fitting holes 71*a* of the cleaning frame 71, respectively, the coupling members 75 are inserted into the rotation holes 26*b*L and 26*b*R and the fitting holes 71*a* from both ends in the axial direction, respectively. With this configuration, the developing unit 20 and the cleaning unit 60 are rotatably coupled to each other around axial lines L1 in FIG. 5 for binding the coupling members 75 inserted from both ends.

In addition, as illustrated in FIG. 5, urging members 46 are provided at base portions of the arm portions 26*a*L and 26*a*R of the developing unit 20. In the state where the developing unit 20 and the cleaning unit 60 are coupled to each other, the urging members 46 abut against the cleaning frame 71 and urge the developing unit 20 toward the cleaning unit 60 with the coupling members 75 as a rotation center. As a result, the developing roller 32 contacts with the drum 62 with a predetermined pressure.

<Developing Unit>

Figure 6:
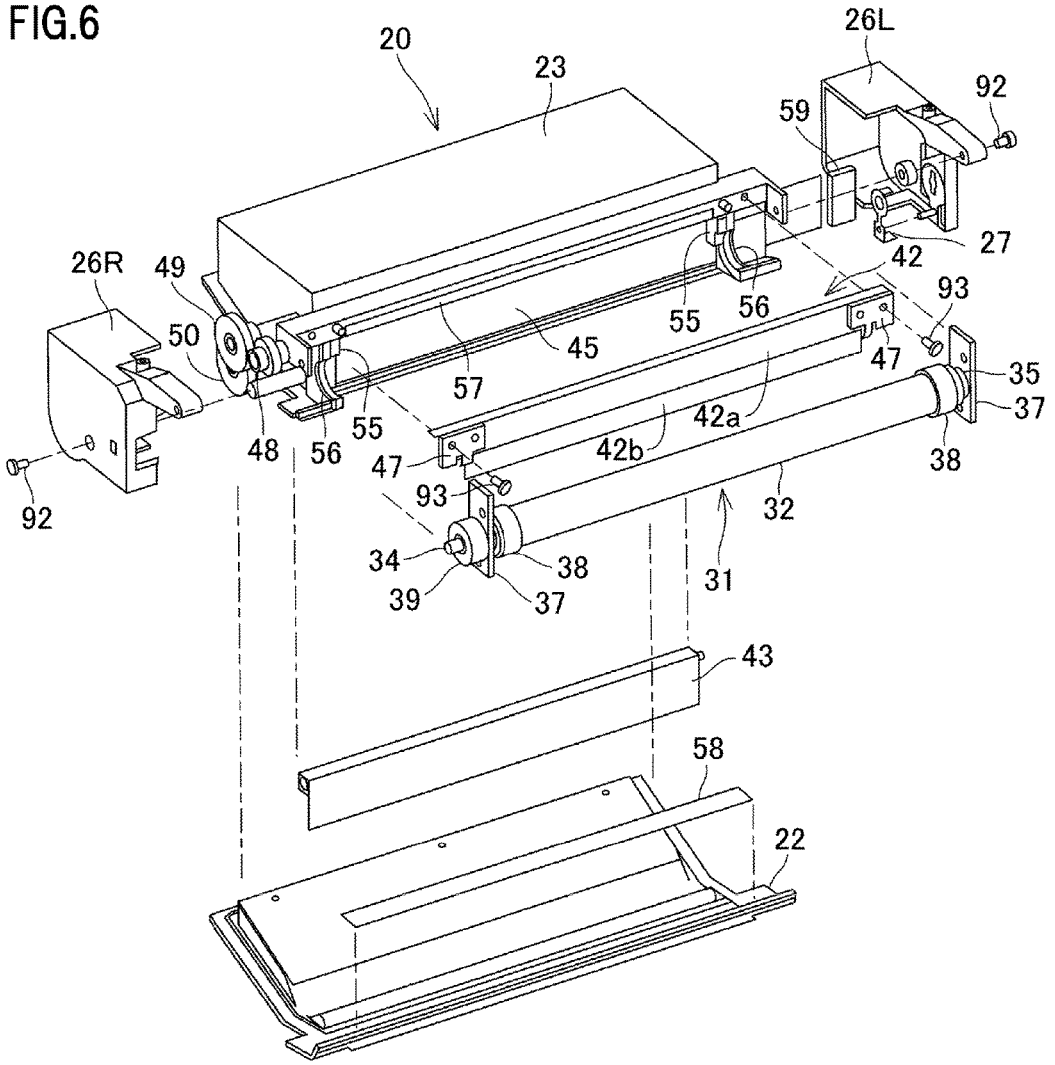
FIG. 6 is an exploded perspective view of a developing unit according to the embodiment.

Furthermore, referring to FIGS. 3, 5, and 6, a configuration of the developing unit will be described in detail. FIG. 6 is an exploded perspective view of the developing unit.

The developing unit 20 further includes a bottom member 22, the magnet roller 34, and the conveying member 43 in addition to the above-described main configurations. The bottom member 22 is integrally coupled to the developer container 23 by welding or the like, thereby forming a developing frame of the developing unit 20 by the developer container 23 and the bottom member 22.

As illustrated in FIG. 3, the developer container 23 includes a toner supply chamber 28 provided with the developing roller 32 enclosing the magnet roller 34 and a toner chamber 29 provided with the conveying member 43 stirring and conveying the accommodated toner T.

A non-driving side of the conveying member 43 is supported by the developer container 23, and a driving side thereof is supported by a conveying gear 50 attached to the developer container 23. As a result, the conveying member 43 is rotated in the toner chamber 29 as the conveying gear 50 rotates.

In addition, the developing unit 20 has a toner sealing member 45 illustrated in FIG. 6. The toner sealing member 45 is welded to the developer container 23 by thermal welding, and the toner chamber 29 and the toner supply chamber 28 are partitioned from each other in the unused cartridge B. This prevents the toner T from being leaked from the toner chamber 29 during transport of the cartridge B. In order to use the cartridge B, when a user opens the toner sealing member 45, the toner T is supplied to the toner supply chamber 28.

The developing blade 42 is configured by a supporting member 42*a* made of a sheet metal and an elasticity member 42*b* formed of an elastic material such as urethane rubber. When the supporting member 42*a* is fixed to the developer container 23 together with a cleaning member 47, the developing blade 42 is fixed to the developer container 23. The developing blade 42 and the cleaning member 47 are fixed to the developer container 23 by securing both ends of the supporting member using screws 93.

The elasticity member 42*b* has a tip contacting with the developing roller 32 and imparts triboelectric charges to the developing roller 32 while regulating the amount of toner on the peripheral surface of the developing roller 32. The cleaning member 47 contacts with an end surface of the developing roller 32, thereby cleaning deposited matters such as toner.

Here, a developing roller unit 31 provided in the developing unit 20 will be described. As illustrated in FIG. 6, the developing roller unit 31 includes the developing roller 32, the magnet roller 34, a flange 35, the gap holding member 38, a bearing member 37, and a developing roller gear 39.

From an end on the non-driving side of the developing roller 32, the magnet roller 34 is inserted, and the flange 35 is fixed in a manner of indentation to the end on the non-driving side. A conductive electrode member (not illustrated) is incorporated in the flange 35, and the electrode member contacts with the developing roller 32 and an electrode member 27. The conductive electrode member 27 is fixed to a first side member 26L. The electrode member 27 contacts with a power supply portion (not illustrated) of the apparatus main body A, and power is supplied to the developing roller 32 using the electrode member 27 and an electrode member (not illustrated) of the flange 35 as a power supply passage.

The gap holding member 38 is attached to both ends of the developing roller 32. The bearing member 37 is disposed outside the gap holding member 38, and in the driving side, the developing roller gear 39 is incorporated outside the bearing member 37. By the bearing member 37 disposed at both ends of the developing roller 32 in the axial direction, the developing roller 32 is rotatably supported.

In addition, first and second gears 48 and 49 as a drive transmission member are rotatably attached to the developing frame. As a result, the driving force received from the apparatus main body A is transmitted to the developing roller 32 and the conveying member 43 by successive engagement and rotation of a flange gear portion 63*b* (see FIG. 7), the developing roller gear 39, the first and second gears 48 and 49, and the conveying gear 50.

In addition, first and second side members 26L and 26R are fixed to the developing frame at both ends in the longitudinal direction using screws 92. At this time, the bearing member 37 of the developing roller unit 31 is held by the first and second side members 26L and 26R.

Furthermore, as illustrated in FIG. 6, the developing unit 20 includes a first sealing member 55, a second sealing member 56, a third sealing member 57, a fourth sealing member 58, and a fifth sealing member 59. The fourth sealing member 58 is provided at a predetermined position of the bottom member 22 after the developer container 23 and the bottom member 22 are coupled to each other. The fifth sealing member 59 is disposed in the developer container 23.

The first sealing member 55 prevents the toner T from being leaked from both longitudinal ends of the elasticity member 42*b* of the developing blade 42. The second sealing member 56 prevents the toner T from being leaked from both longitudinal ends of the developing roller 32. The third sealing member 57 is provided over the longitudinal direction and prevents the toner T from being leaked from a space between the supporting member 42*a* of the developing blade 42 and the developer container 23. The fourth sealing member 58 is provided to come in contact with the developing roller 32 over the longitudinal direction and prevents the toner T from being leaked from a lower side of the developing roller 32. When the toner sealing member 45 is opened and is taken out from an takeout opening (not illustrated) out of the developing unit 20, the fifth sealing member 59 wipes the toner T deposited on the surface of the toner sealing member 45 and prevents the toner T from being leaked by coming in tightly contact with the takeout opening.

<Configuration of Cleaning Unit>

Figure 7:
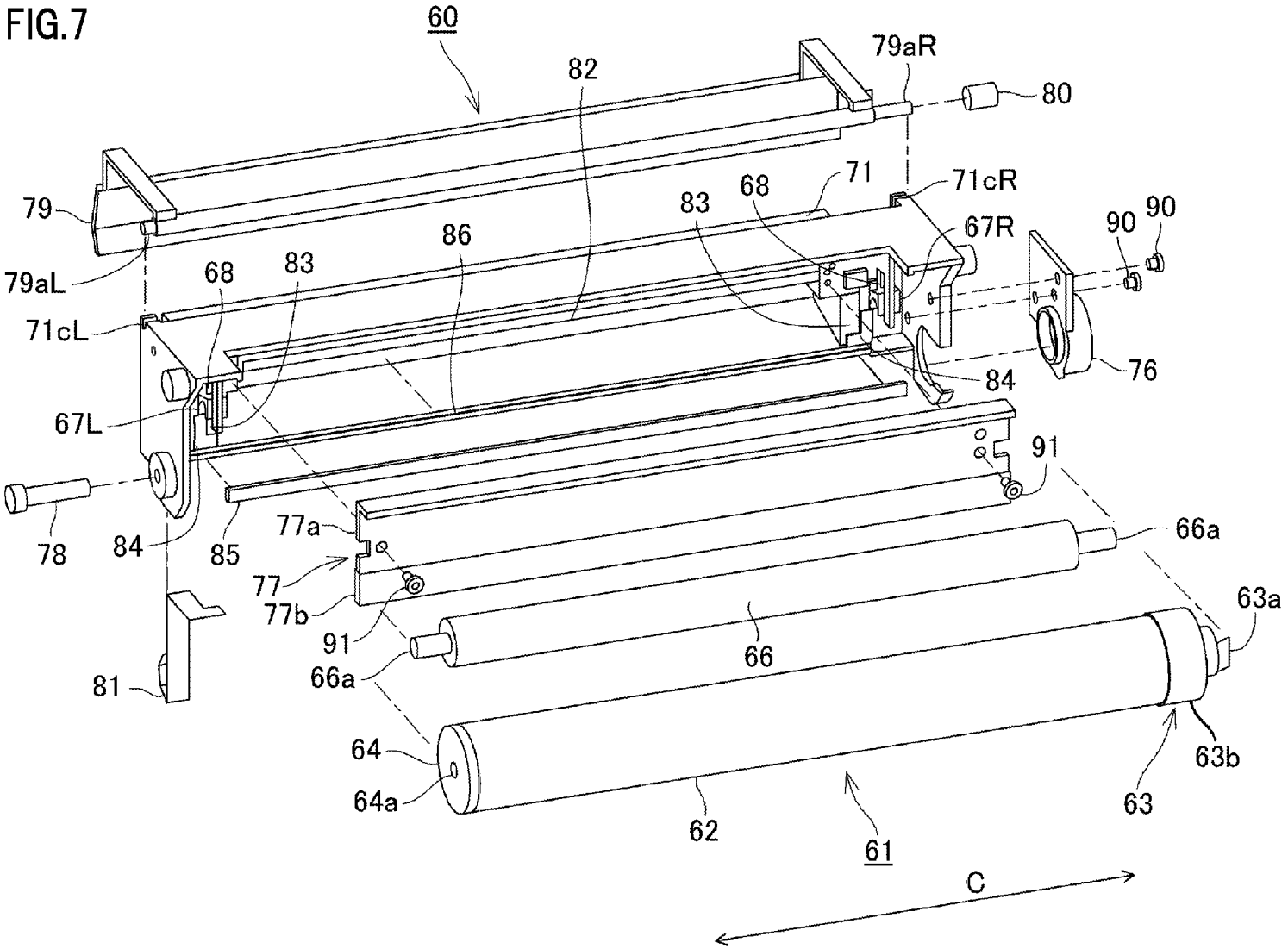
FIG. 7 is an exploded perspective view of a cleaning unit according to the embodiment.

Referring to FIGS. 3, 5, and 7, a configuration of the cleaning unit will be described below in detail. FIG. 7 is an exploded perspective view of the cleaning unit.

The cleaning blade 77 provided in the cleaning unit 60 is configured by a supporting member 77*a* made of a sheet metal and an elasticity member 77*b* formed of an elastic material such as urethane rubber. When the supporting member 77*a* is fixed to the cleaning frame 71, the cleaning blade 77 is disposed at a predetermined position with respect to the cleaning frame 71. The cleaning blade 77 is fixed to the cleaning frame 71 by securing both ends of the cleaning blade 77 using screws 91.

The elasticity member 77*b* of the cleaning blade 77 has a tip contacting with the drum 62 and thus removes the toner deposited on the outer peripheral surface of the drum 62. The toner removed by the cleaning blade 77 is stored in the waste toner chamber 71*b* which is illustrated in FIG. 3 and provided in the cleaning unit 60.

In addition, the cleaning unit 60 includes a first sealing member 82, a second sealing member 83, an adhesive sealing member (sealing member) 84, and a flexible sheet member (sheet member) 85.

The first sealing member 82 is provided over the longitudinal direction (rotational axis direction) C and prevents the waste toner from being leaked from a space between the supporting member 77*a* of the cleaning blade 77 and the cleaning frame 71. The second sealing member 83 prevents the waste toner from being leaked from both longitudinal ends of the elasticity member 77*b* of the cleaning blade 77. The adhesive sealing member 84 wipes deposited matters such as toner on the drum 62 while preventing the waste toner from being leaked from both longitudinal ends of the elasticity member 77*b* of the cleaning blade 77.

The flexible sheet member 85 is made of a plastic film, for example, polyethylene terephthalate, polyphennylene sulfide or the like and has a thickness of about 38 μm in this embodiment. The flexible sheet member 85 is attached to cleaning frame 71 to come in contact with the drum 62 over the longitudinal direction C and prevents the waste toner from being leaked from an upstream side in the rotation direction of the drum 62 with respect to the cleaning blade 77.

In addition, the cleaning unit 60 includes an electrode member 81, an urging member 68, charging roller bearings 67L and 67R. These members are attached to the cleaning frame 71. A shaft portion 66*a* of the charging roller 66 is incorporated in the charging roller bearings 67L and 67R. The charging roller 66 is urged toward the drum 62 by the urging member 68 and is rotatably supported by the charging roller bearings 67L and 67R. Then, the charging roller 66 is driven to rotate by rotation of the drum 62.

The electrode member 81, the urging member 68, the charging roller bearing 67L, and the shaft portion 66*a* have conductivity. The electrode member 81 comes in contact with a power supply portion (not illustrated) of the apparatus main body A. Power is supplied to the charging roller 66 using these members as a power supply passage.

The drum 62 is integrally coupled to flanges 63 and 64 and thus is configured as an electrophotographic photosensitive drum unit (hereinafter, referred to as a drum unit 61). This coupling method uses caulking, bonding, welding or the like. An earth contact and the like (not shown in figures) are coupled to the flange 64. Further, the flange 63 includes a driving force receiving portion 63*a* for receiving a driving force from the apparatus main body A and a flange gear portion 63*b* for transmitting the driving to the developing roller 32.

The bearing member 76 is integrally fixed to the driving side of the cleaning frame 71 by screws 90, and a drum shaft 78 is fixed to the non-driving side of the cleaning frame 71 in a manner of indentation. Further, the bearing member 76 is fitted with the flange 63, and the drum shaft 78 is fitted with a hole 64*a* of the flange 64. As a result, the drum unit 61 is rotatably supported by the cleaning frame 71. However, the bearing member 76 may be fixed to the cleaning frame 71 using another means without being limited to the screws 90.

In addition, the cleaning unit 60 includes a protection member 79, which is rotatably supported by the cleaning frame 71, so as to be capable of protecting (blocking out light) and exposing the drum 62. In addition, the cleaning unit 60 includes an urging member 80 which is attached to a shaft portion 79*a*R on the driving side of the protection member 79 and urges the protection member 79 in a direction to protect the drum 62. A shaft portion 79*a*L on the non-driving side of the protection member 79 and the shaft portion 79*a*R on the driving side thereof are fitted with bearing portions 71*c*L and 71*c*R of the cleaning frame 71, respectively.

<Molding Elastomer Member into Cleaning Frame>

Molding of an elastomer member as a resin-molded portion into the cleaning frame will be described below with reference to FIGS. 8A to 11B. An elastomer member 86 is a member used to fix the sheet member 85 to the cleaning frame 71.

Figure 8A:
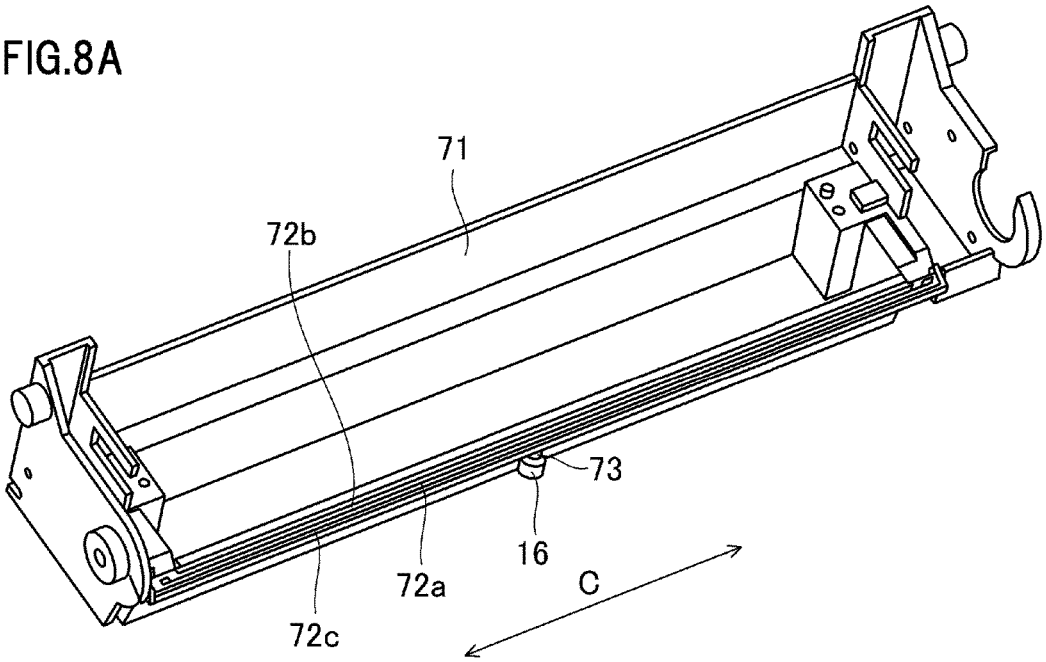
FIGS. 8A and 8B are diagrams for illustrating molding of an elastomer member.
Figure 8B:
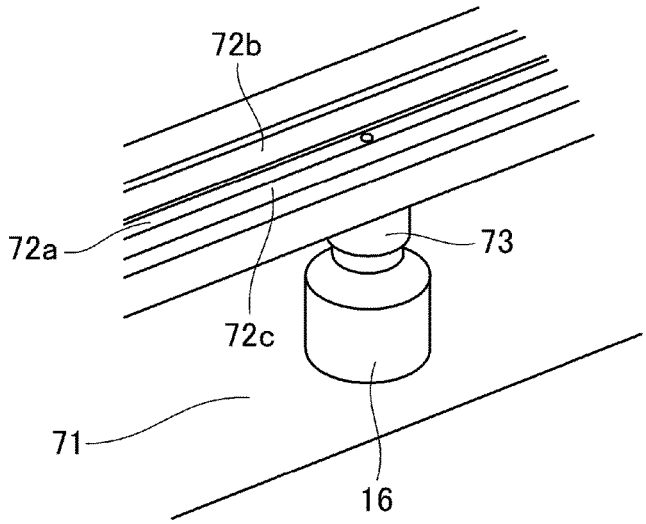
Figure 9A:
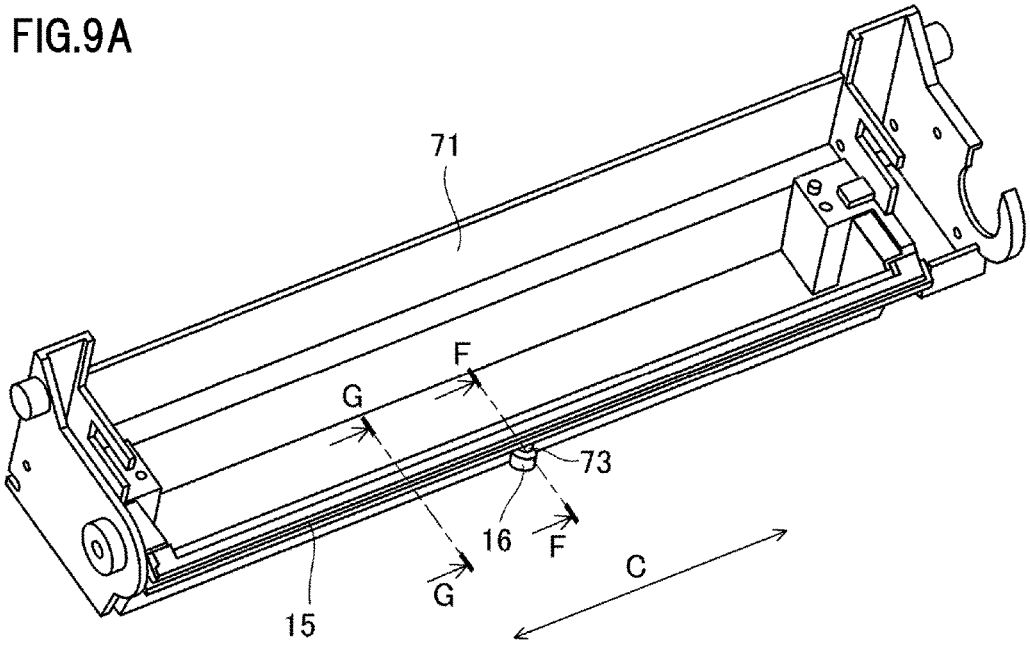
FIGS. 9A to 9C are diagrams illustrating a state where a mold is clamped to a cleaning frame.
Figure 9B:
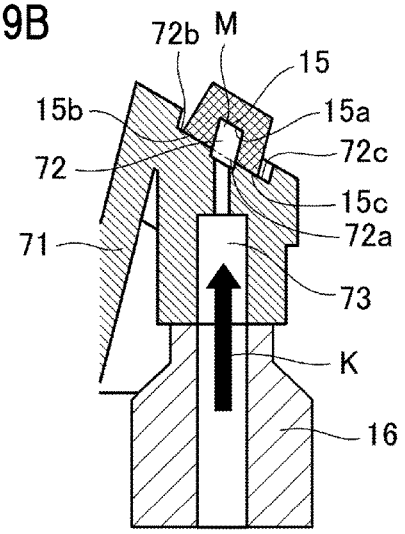
Figure 9C:
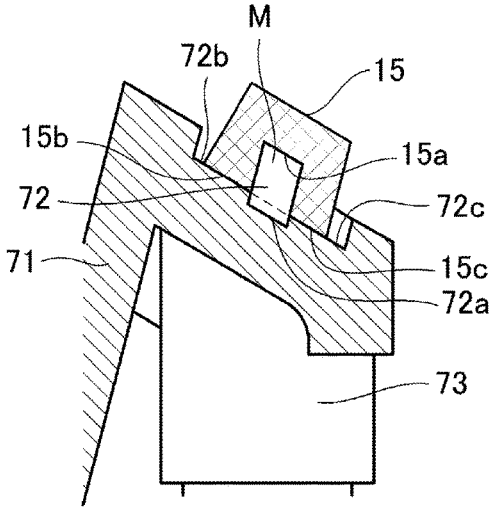
Figure 10A:
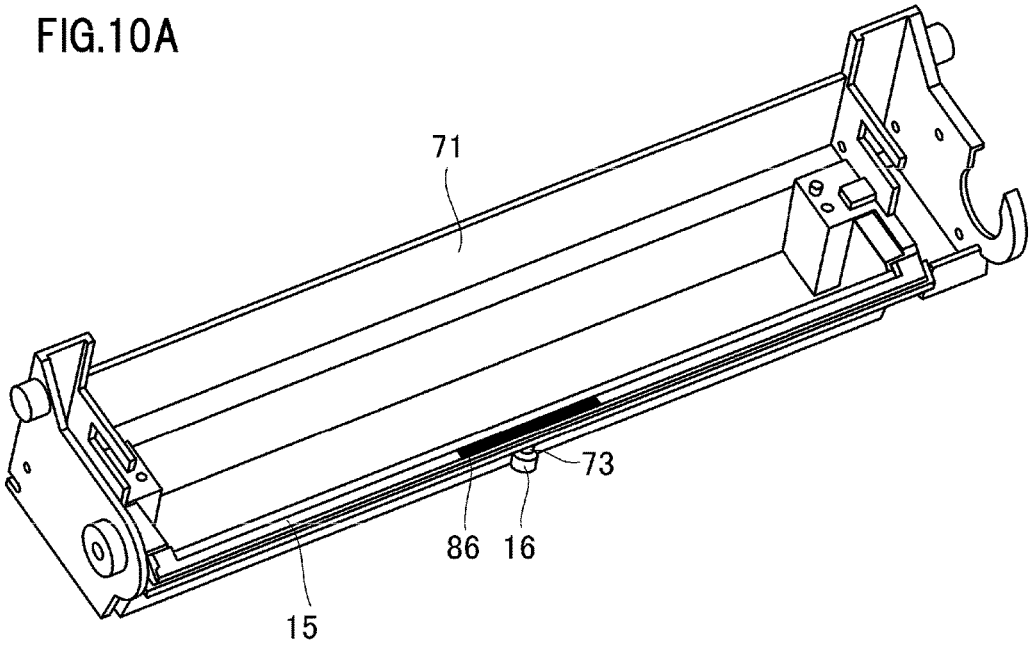
FIGS. 10A and 10B are diagrams illustrating states during the molding of the elastomer member.
Figure 10B:
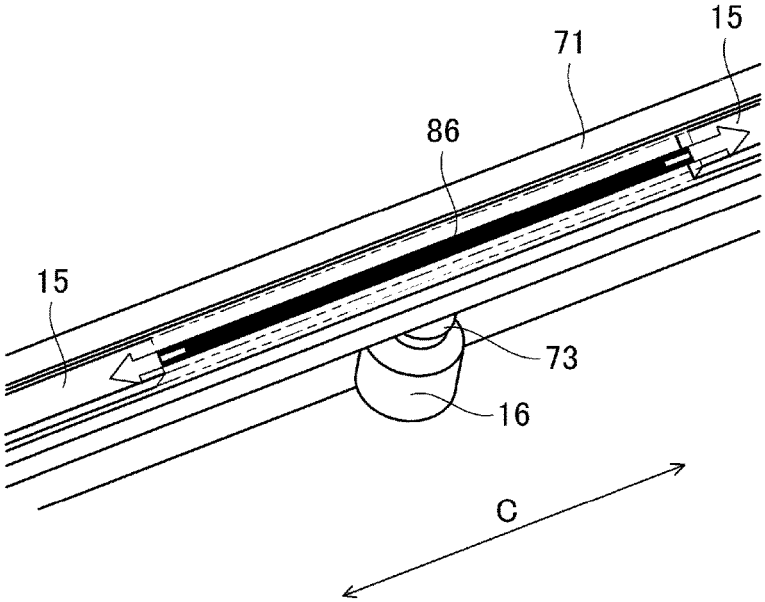
Figure 11A:
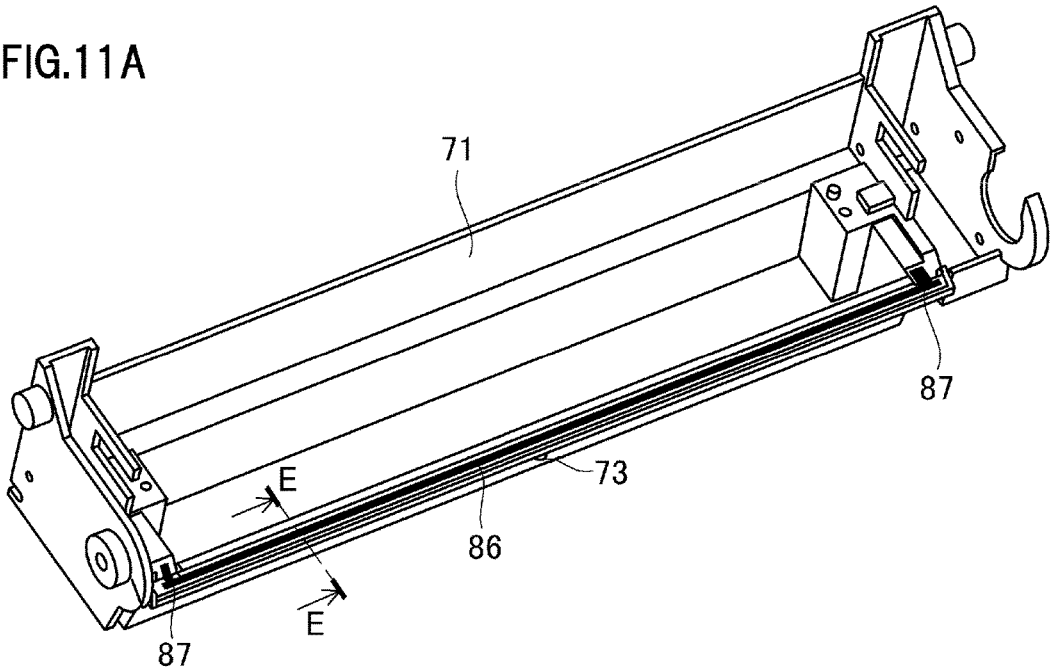
FIGS. 11A and 11B are diagrams illustrating states after the molding of the elastomer member.
Figure 11B:
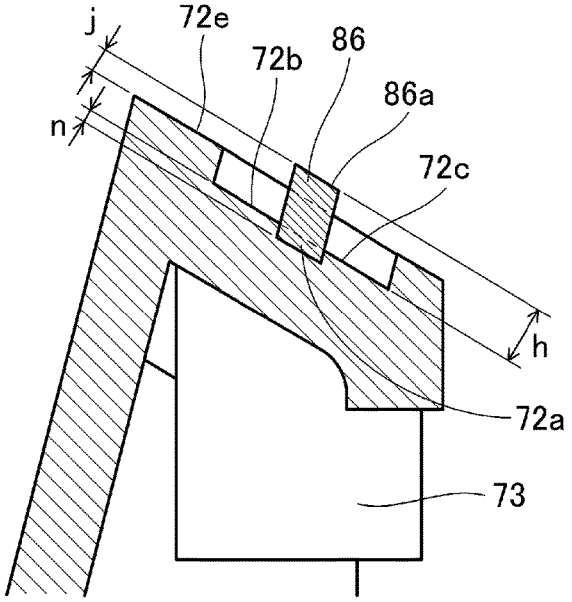

FIGS. 8A and 8B are diagrams for illustrating the molding of the elastomer member. FIG. 8A is a perspective view of the cleaning frame, FIG. 8B is an enlarged view of the vicinity of an injection port of the cleaning frame. FIGS. 9A to 9C are diagrams illustrating a state where a mold as a molding die is pressed (clamped) against the cleaning frame. FIG. 9A is a perspective view, FIG. 9B is a schematic sectional view taken along the line F-F illustrated in FIG. 9A, and FIG. 9C is a schematic sectional view taken along the line G-G illustrated in FIG. 9A. FIGS. 10A and 10B are diagrams illustrating states during the molding of the elastomer. FIG. 10A is a perspective view and FIG. 10B is an enlarged view of the vicinity of an injection port. FIGS. 11A and 11B are diagrams illustrating states after the molding of the elastomer member. FIG. 11A is a perspective view and FIG. 11B is a sectional view taken along the line E-E illustrated in FIG. 11A.

As illustrated in FIGS. 8A, 8B, 9A, and 10B, a molding portion 72 of the elastomer member 86 as the resin-molded portion is provided in the cleaning frame 71. The molding portion 72 includes a depressed portion 72*a* into which the elastomer is injected and contact surfaces 72*b* and 72*c* which contact with a mold 15.

In addition, a cylindrical injection port 73 is provided at a predetermined position in the longitudinal direction C of the cleaning frame 71 and communicates with the depressed portion 72*a* of the molding portion 72. In this embodiment, the injection port 73 is provided at one longitudinal central position of the molding portion 72 as illustrated in FIG. 8A, but a plurality of injection ports may be provided without being limited thereto.

Next, a molding method of the elastomer member 86 as the resin-molded portion will be described. When the elastomer member 86 is molded, as illustrated in FIGS. 9A, 9B, and 9C, contact regions 15*b* and 15*c* of the mold 15 are pressed against the contact surfaces 72*b* and 72*c* of the molding portion 72 of the cleaning frame 71. For this reason, as illustrated in FIG. 9B, a molding space (cavity) M is formed by the depressed portion 72*a* of the molding portion 72 of the cleaning frame 71 and the depressed portion 15*a* of the mold 15 as the molding die. The depressed portion 15*a* of the mold 15 has a shape corresponding to an outer shape of the elastomer member 86.

Subsequently, a gate 16 of a resin injection device (not illustrated) is contacted with the injection port 73 provided at one longitudinal central position of the cleaning frame 71 (see FIG. 9A). Then, thermoplastic resin (resin material), which is a raw material of the elastomer member 86, is injected into the injection port 73 of the cleaning frame 71 from the gate 16 of the resin injection device in a direction indicated by an arrow K (see FIG. 9B) and the thermoplastic resin is poured into the molding space M (see FIGS. 10A and 10B). As illustrated in FIG. 10B, the injected thermoplastic resin flows to ends on both sides in the longitudinal direction C through the molding space M. In this way, by injection molding of the thermoplastic resin in the molding space M formed by the contact of the cleaning frame 71 with the mold 15, the elastomer member 86 is integrally molded with the cleaning frame 71. Although the details will be described below, the elastomer member 86 is provided with end seal portions 87 at both ends in the longitudinal direction C. That is, the end seal portions 87 are configured as a part of the elastomer member 86. In this embodiment, portions of the elastomer member 86 extending in the longitudinal direction C and the end seal portions 87 are molded at the same time, but may be separately molded.

The elastomer member 86 is provided by integrally molding with the cleaning frame 71. In this embodiment, a material of the elastomer member 86 is a styrene-based elastomer resin and a material of the cleaning frame 71 is HI-PS. Thus, since the elastomer member 86 and the cleaning frame 71 are made of the same kind of material, such components are not required to be disassembled together during recycling. That is, disassembling workability of the cartridge B is excellent during the recycling.

An elastomer resin other than the above material may be used as long as having the same mechanical properties. The elastomer member 86 may have a modulus of elasticity of 2.5 MPa to 10 MPa. The elastomer member 86 of this embodiment is prepared by incorporating 20 parts by weight of polystylene (PE) with respect to 100 parts by weight of the styrene-based elastomer resin such that the modulus of elasticity is in the range of 2.5 MPa to 10 MPa. When the modulus of elasticity is in the range described above, the content of PE may be changed and a resin other than the PE may be contained.

In addition, as illustrated in FIG. 11B, a free length (height) "h" during the molding of the elastomer member 86 is set to be 0.5 mm or more. In addition, a difference "n" in level on the depressed portion 72*a* of the molding portion 72 is 0.3 mm and some of the elastomer member 86 is molded in the depressed portion 72*a* of the cleaning frame 71. Thus, the elastomer member 86 is fixed to the cleaning frame 71.

Furthermore, a welding portion 86*a* of the elastomer member 86 which is used to weld the flexible sheet member 85 is configured to be higher than the regulating surface 72*e* of the flexible sheet member 85 in the cleaning frame 71 by a melting portion "j" of the elastomer member 86.

Further, if the elastomer member 86 has sufficiently adhesive property with respect to the cleaning frame 71, the cleaning frame 71 is not required to include the depressed portion 72*a*. In addition, the free length (height) "h" during the molding of the elastomer member 86 is set to be 0.5 mm or more, but is not limited thereto. With respect to the molding of the elastomer member 86, two-color molding or insert molding may be employed in addition to the above method.

<Welding Process of Flexible Sheet Member>

Figure 12A:
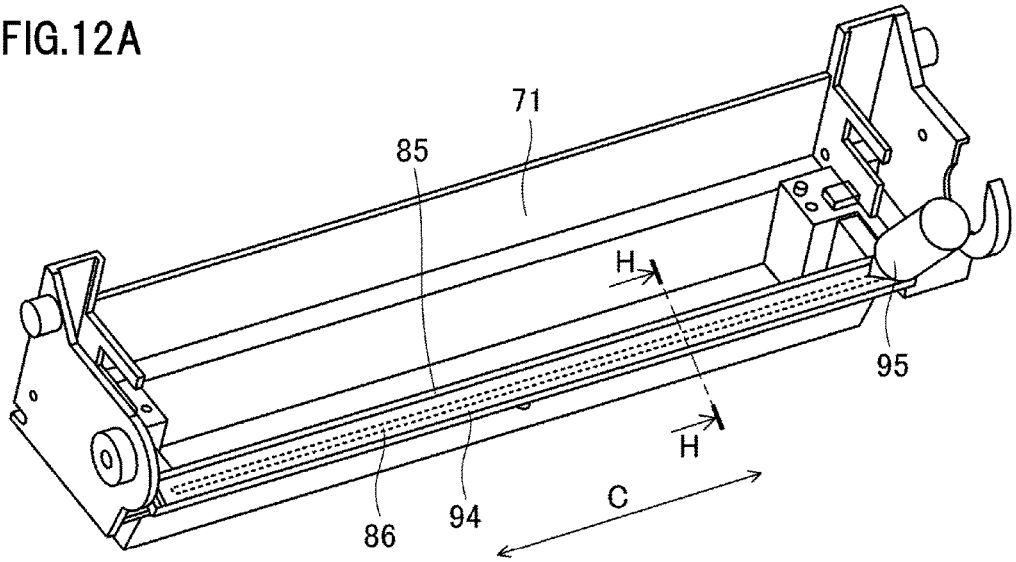
FIGS. 12A and 12B are diagrams illustrating a state where a flexible sheet member is welded.
Figure 12B:
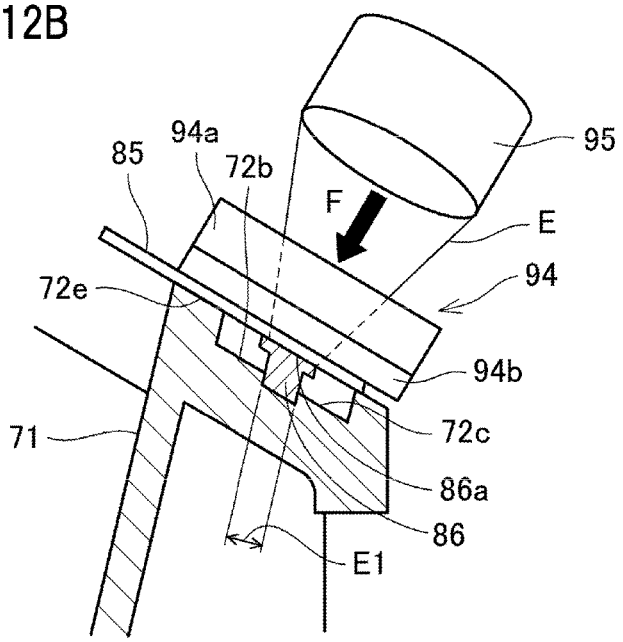

Referring to FIGS. 12A and 12B, a welding process of the flexible sheet member to the elastomer member will be described below. FIGS. 12A and 12B are diagrams illustrating a state where the flexible sheet member is welded by melting of the elastomer member. FIG. 12A is a perspective view and FIG. 12B is a sectional view taken along the line H-H illustrated in FIG. 12A. In this embodiment, the flexible sheet member 85 having a thickness of 38 μm and beam transmittance of 85% (960 nm in a near-infrared ray) was used. In FIG. 12A, dotted lines indicate a state of being seen through the elastomer member 86.

As illustrated in FIGS. 12A and 12B, first, the welding portion 86*a* of the elastomer member 86 is overlapped with the flexible sheet member 85 so as to come in contact with each other. Subsequently, the flexible sheet member 85 is pressed by a pressing jig 94 in a direction opposite to a side of the flexible sheet member 85 which comes in contact with the elastomer member 86. At this time, the pressing jig 94 is pressed by force F which is applied such that the flexible sheet member 85 comes in contact with a regulating surface 72*e* for regulating a position of the flexible sheet member 85. Thus, a temporal position is determined such that relative placement of the flexible sheet member 85 with respect to the cleaning frame 71 is not deviated from each other during bonding of the flexible sheet member 85 and the elastomer member 86. In addition, the pressing jig 94 is made of a material to which the near-infrared ray is transmitted.

Thereafter, irradiation of a laser light E of the near-infrared ray is performed toward the welding portion 86*a* of the elastomer member 86 from a laser irradiation head (hereinafter, referred to as an irradiation head) 95 in a direction indicated by an arrow F in FIG. 12B. The elastomer member 86 contains a carbon black to absorb the near-infrared ray. For this reason, the irradiated laser light E is transmitted through the pressing jig 94 and the flexible sheet member 85 which have the transmissive of the near-infrared ray and is absorbed by the welding portion 86*a* of the elastomer member 86.

The laser light E absorbed by the welding portion 86*a* is converted into heat, the welding portion 86*a* generates heat, and the elastomer member 86 is melted by the heat. The elastomer member 86 can be welded (adhered) to the flexible sheet member 85 coming in contact with the welding portion 86*a* by the melting thereof. At this time, the molten welding portion 86*a* has substantially the same plane as the regulating surface 72*e*.

Here, the laser light E emitted from the irradiation head 95 was focused to a circular spot of 1.5 mm in diameter φ when it reached the welding portion 86*a*. That is, a spot diameter φ of the laser is 1.5 mm. Further, when a molding width of the elastomer member 86 is smaller than 1.5 mm, it is possible to uniformly melt the welding portion 86*a* of the elastomer member 86. In this embodiment, a melting width E1 of the elastomer member 86 was set to be about 1.0 mm. Further, the irradiation of the laser light E is continuously performed from one end of the flexible sheet member 85 to the other end in longitudinal direction C. As a result, the welding of the flexible sheet member 85 and the elastomer member 86 is completed over the longitudinal direction.

Further, as the pressing jig 94, a member is preferably used which has the transmissive to the laser light E and has a rigidity capable of pressing an entire contact surface between the flexible sheet member 85 and the welding portion 86*a* of the elastomer member 86 molded in the cleaning frame 71. Specifically, the pressing jig 94 may be formed using acrylic resin, glass and the like.

Furthermore, in this embodiment, the pressing jig 94 was configured to include a pressing member 94*b* of an elasticity body. By the pressing member 94*b*, the flexible sheet member 85 is elastically pressed against the cleaning frame 71 and thus the temporal position is determined, so that the adhesiveness between the flexible sheet member 85 and the welding portion 86*a* can be improved. Further, positional deviation of the flexible sheet member 85 can be prevented. Specifically, the pressing jig 94 used in this embodiment was configured by adhering an acrylic member 94*a* as a rigid member and a 5 mm-thick silicone rubber member (pressing member) 94*b* as an elasticity body to each other with a transmissive double-sided tape.

Further, as a near-infrared ray irradiation device, FD200 (wavelength: 960 nm) made by FINE DEVICE Co., Ltd. was used. Here, a scanning speed in a longitudinal direction of the near-infrared ray irradiation device was set to be 50 mm/sec, an output was set to be 20 W, and a spot diameter φ on the surface of the elastomer member 86 was set to be 1.5 mm. In addition, an energy density at the surface of the elastomer member 86 was set to be 0.22 J/mm$^2$. Further, the elastomer member 86 prepared by incorporating 0.5 to 12.0 parts by mass of a carbon black having a number average particle size of 16 nm with respect to 100 parts by mass of the styrene-based elastomer resin was used.

The above-described bonding method between the flexible sheet member 85 and the elastomer member 86 molded in the cleaning frame 71 can also be applied to the developing unit 20. For example, it can also be applied to the welding between the fourth sealing member 58 and an elastomer member (not illustrated) molded in the developer container 23. Further, in this embodiment, the flexible sheet member 85 having the beam transmittance of 85% is used, but the welding can also be performed by a sheet member having the beam transmittance of 85% or less. Further, in addition to the welding method of this embodiment, the elastomer member 86 and the flexible sheet member 85 can be welded to each other using a heat seal or the like. In the case of using the heat seal or the like, since heat is not transferred to only a contact interface between the flexible sheet member 85 and the elastomer member 86 but is transferred from the upper surface of the flexible sheet member 85, it is also necessary to take into account a heat transfer time and the melting of the flexible sheet member 85.

<Seal Configuration of Drum End>

Referring to FIG. 1 and FIGS. 13A to 17B, a seal configuration of a drum end in the cleaning frame which is a characteristic configuration of this embodiment will be described below. Since the seal configuration of a driving side is similar to that of a non-driving side, the configuration of the driving side will be described below and the configuration of the non-driving side will not be described.

Figure 1:
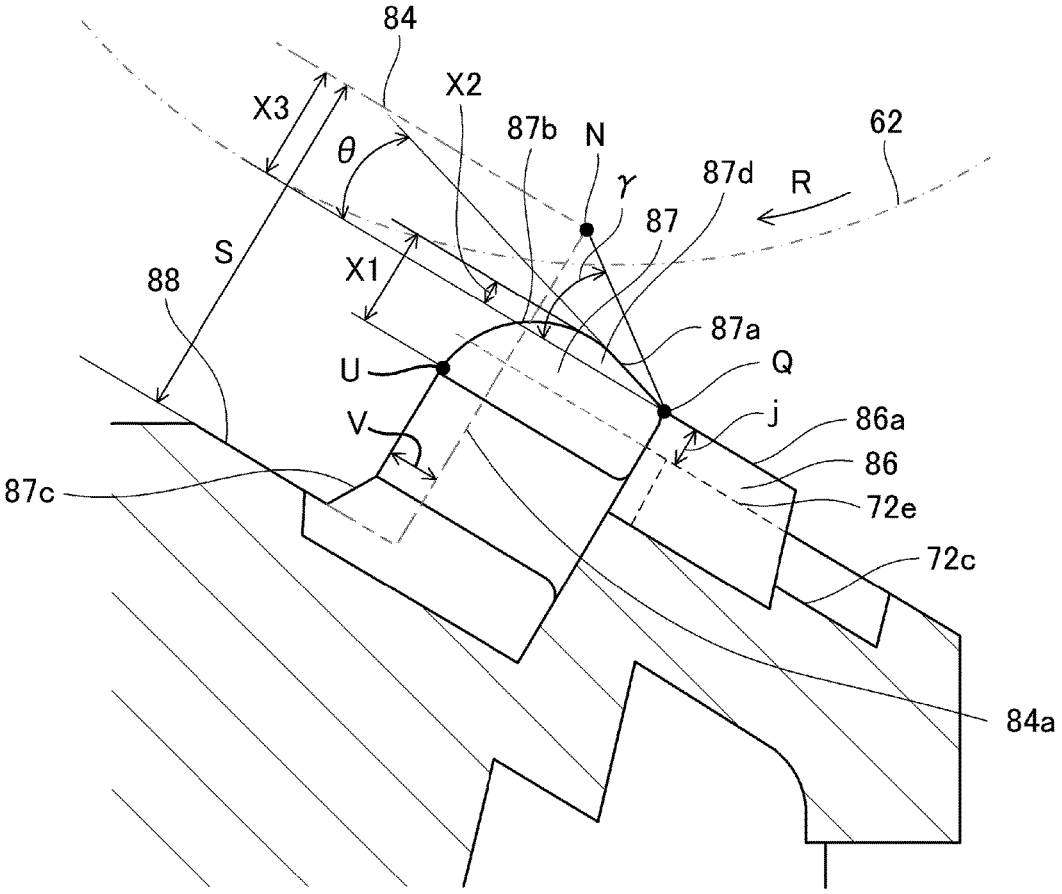
FIG. 1 is a sectional view taken along line K-K illustrated in FIG. 13A.
Figure 13A:
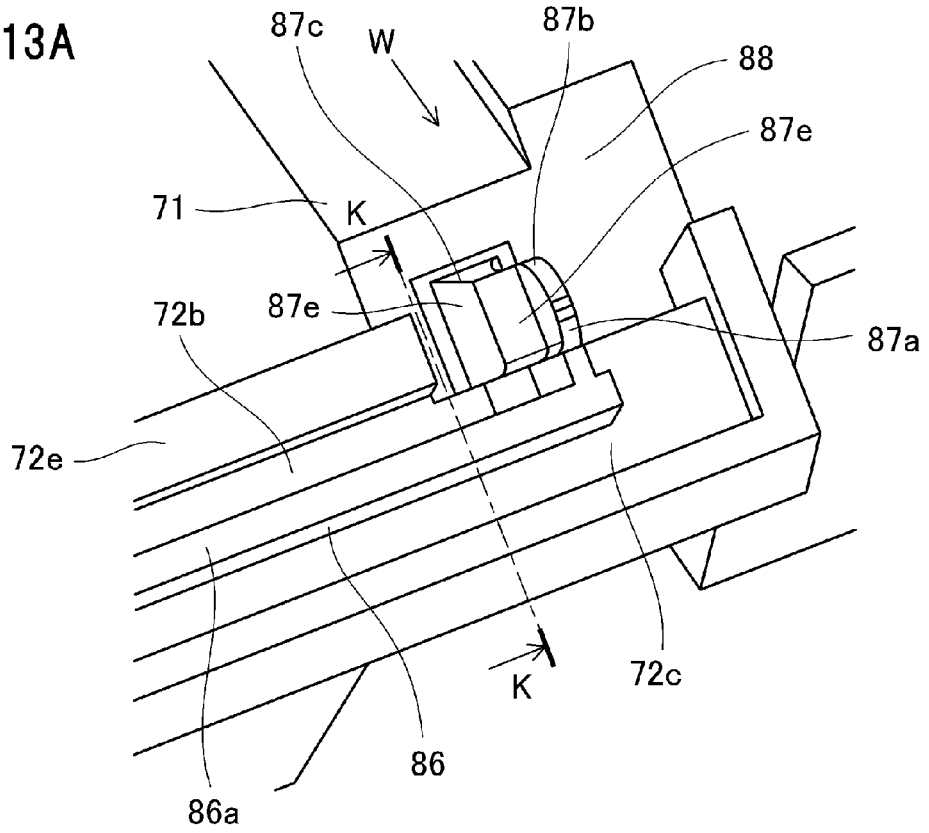
FIGS. 13A and 13B are diagrams illustrating a seal configuration of a drum end.
Figure 13B:
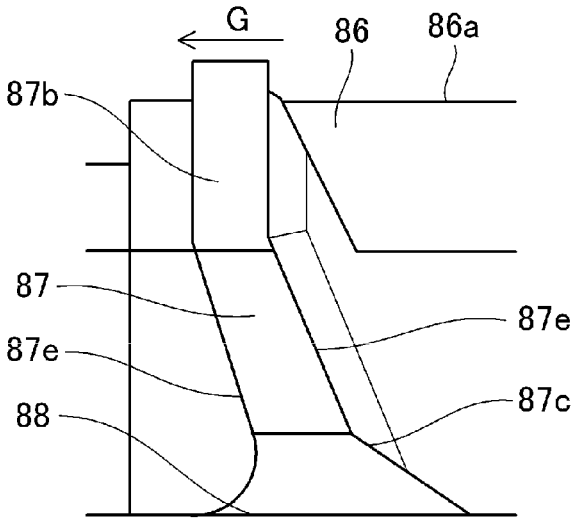

FIGS. 13A and 13B are diagrams illustrating the seal configuration of the drum end. FIG. 13A is a perspective view and FIG. 13B is a diagram when FIG. 13A is viewed from a direction indicated by W. In addition, FIG. 1 is a sectional view taken along the line K-K illustrated in FIG. 13A. The two-dot chain line in FIG. 1 indicates a state before an end seal portion is compressed by the drum and a chain line in FIG. 1 indicates a state where the drum is assembled.

Figure 14A:
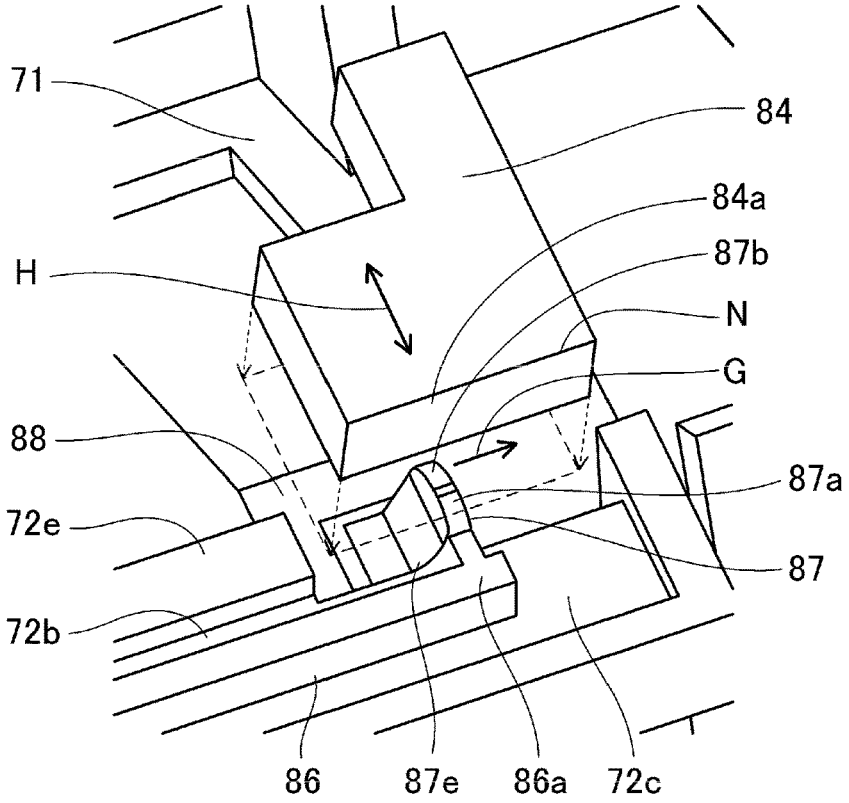
FIGS. 14A and 14B are perspective views for illustrating adhesion of an adhesive sealing member.
Figure 14B:
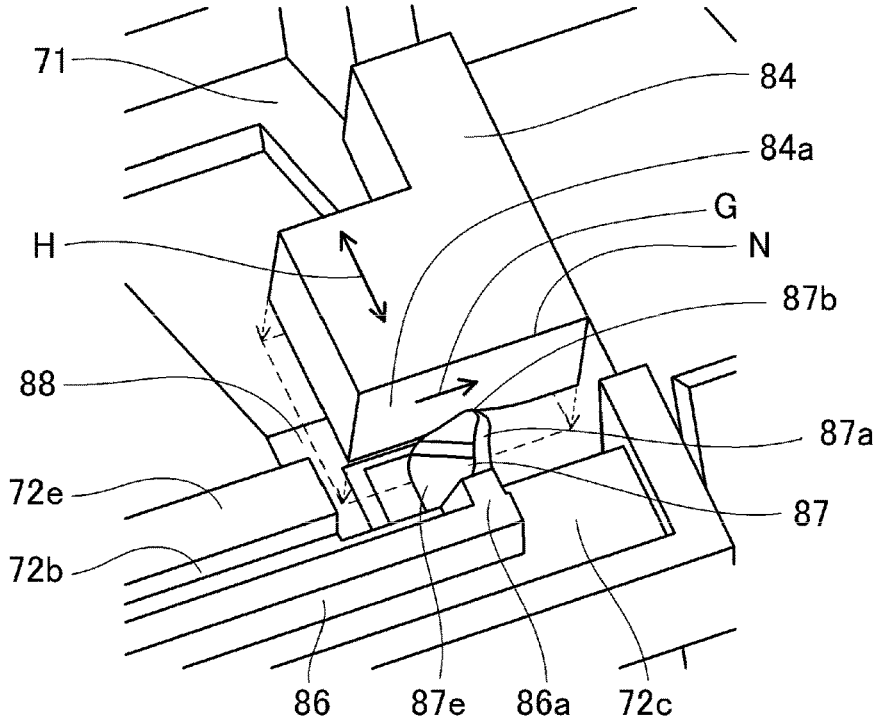

FIGS. 14A and 14B are perspective views for illustrating adhesion of an adhesive sealing member. FIG. 14A is the perspective view illustrating a state before the adhesive sealing member is adhered, and FIG. 14B is the perspective view illustrating a state where the end seal portion starts to bend in the course of the adhesion of the adhesive sealing member.

Figure 15A:
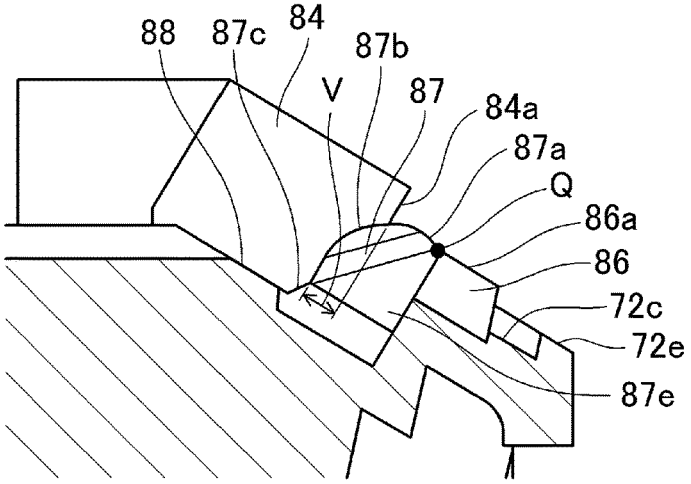
FIGS. 15A to 15C are diagrams for illustrating assembly processes of a drum.
Figure 15B:
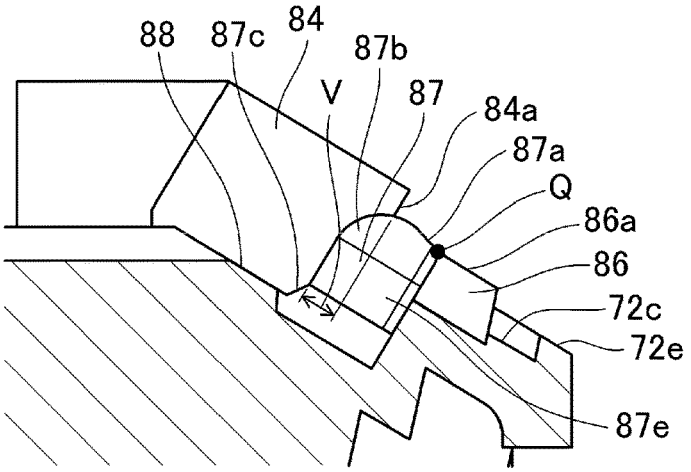
Figure 15C:
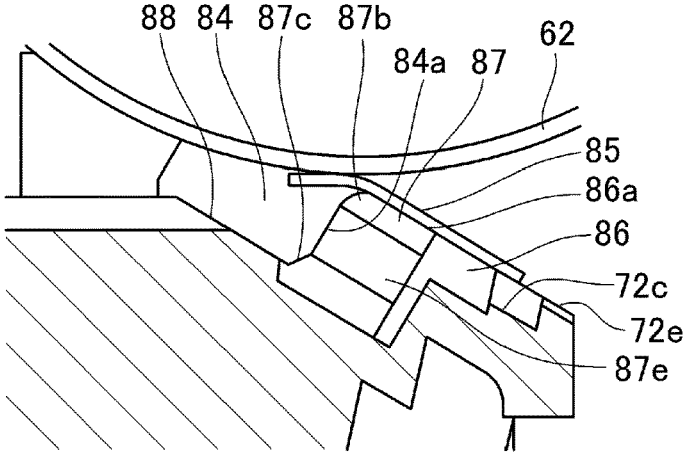

FIGS. 15A to 15C are diagrams for illustrating adhesion of the adhesive sealing member and assembly of the drum. FIG. 15A is the sectional view illustrating a state where the adhesive sealing member is adhered and the end seal portion is compressed and bent. FIG. 15B is the sectional view illustrating a state where the adhesive sealing member is adhered and the bent end seal portion is restored to its original state. FIG. 15C is the sectional view illustrating a state where the flexible sheet member is adhered and the drum is assembled.

Figure 16:
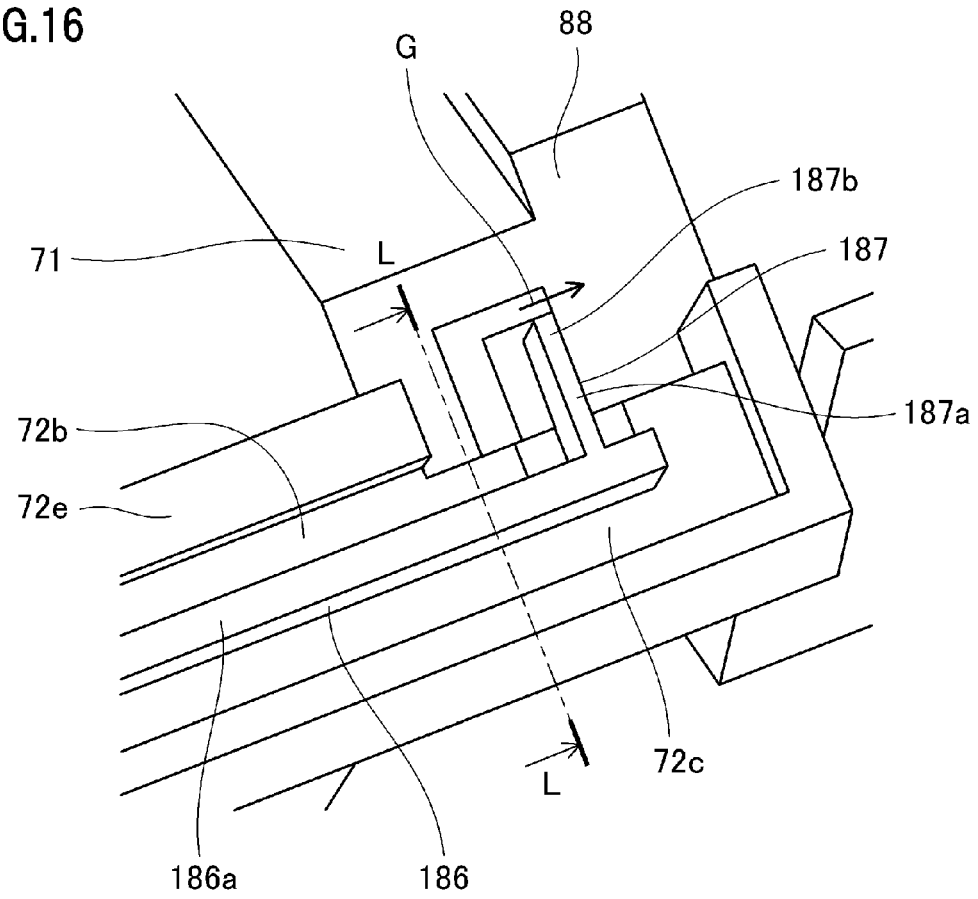
FIG. 16 is a perspective view illustrating a seal configuration of a drum end according to a comparative example.
Figure 17A:
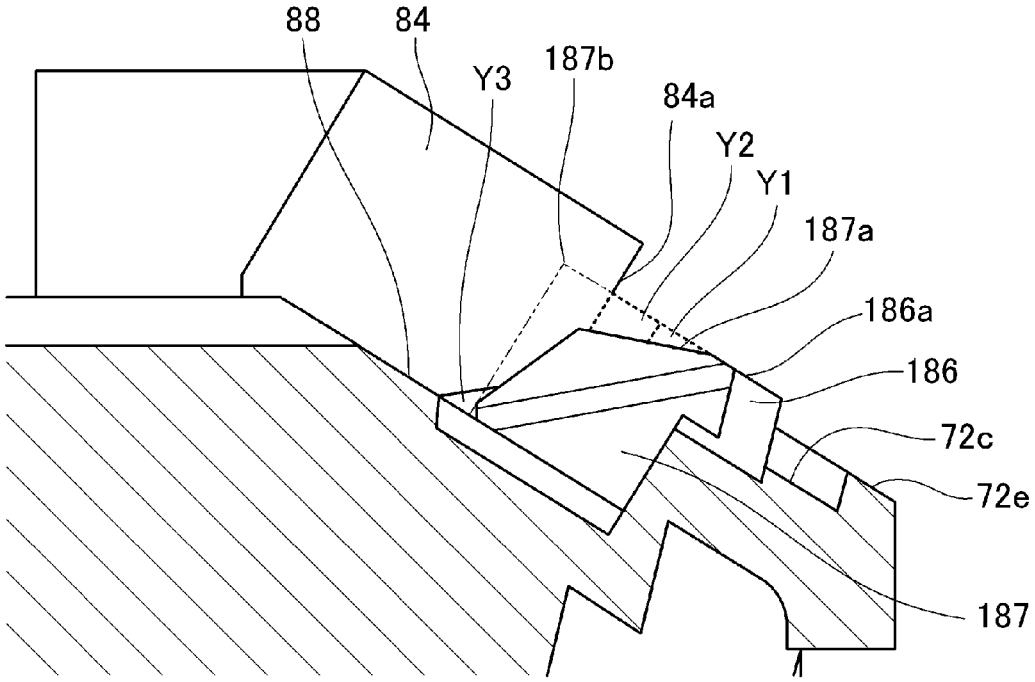
FIGS. 17A and 17B are sectional views illustrating the seal configuration of the drum end according to the comparative example.
Figure 17B:
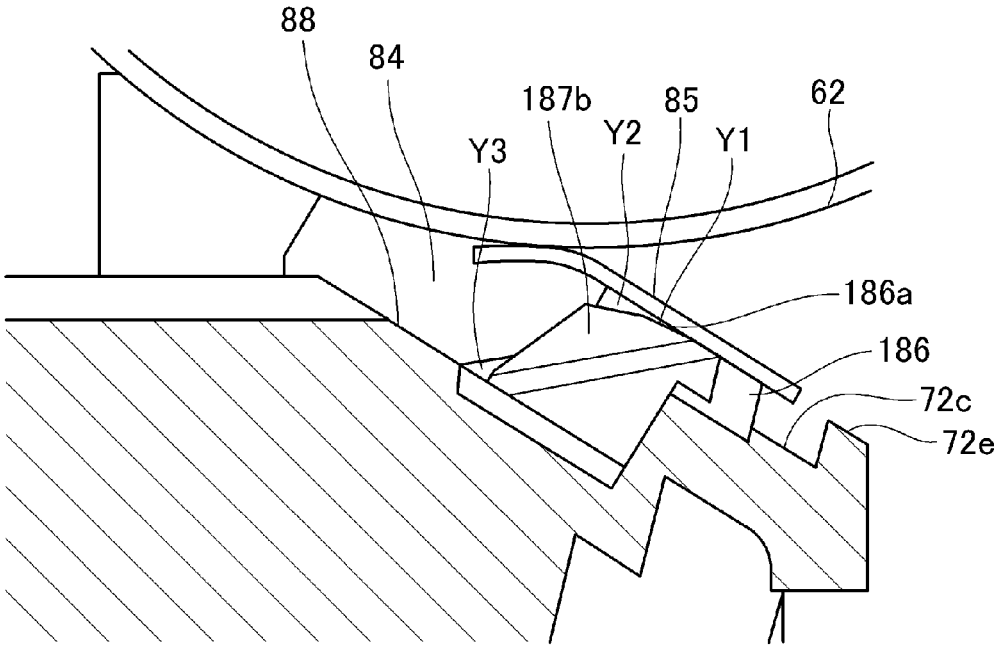

FIG. 16 is a perspective view illustrating a seal configuration of a drum end according to a comparative example. FIGS. 17A and 17B are sectional views illustrating the seal configuration of the drum end according to the comparative example. FIG. 17A is the sectional view illustrating a state where the adhesive sealing member is adhered and the end seal portion is bent in the comparative example. FIG. 17B is the sectional view illustrating a state where the flexible sheet member is adhered and the drum is assembled in the comparative example. In the comparative example, the elastomer member is integrally molded with the cleaning frame by the injection molding as in this embodiment, but the shape of the end seal portion is different from that of this embodiment.

First, the adhesion of the adhesive sealing member 84 will be described. The adhesive sealing member 84 is compressed and mounted between the cleaning frame 71, an end in a rotational axis direction of the drum 62, and an end in a rotational axis direction of the sheet member 85 and is a member for preventing a leakage of the toner from the end in the rotational axis direction.

As illustrated in FIG. 14A, the adhesive sealing member 84 is adhered to an adhesive seating surface 88 of the cleaning frame 71 in a vertical direction. The adhesive sealing member 84, which is adhered to the adhesive seating surface 88, penetrates into the end seal portion 87 by a penetration level V (see FIG. 1) in a direction indicated by an arrow H in FIG. 14A. In this embodiment, the penetration level V is determined in consideration of a manufacturing error and an assembly error of the adhesive sealing member 84 and a manufacturing error of the end seal portion 87.

When the adhesive sealing member 84 is adhered without penetrating into the end seal portion 87 in the direction indicated by the arrow H, there is a case where the sealing member 84 and the end seal portion 87 do not come in contact with each other due to the manufacturing error and the assembly error of the adhesive sealing member 84. Thus, a gap is formed between the adhesive sealing member 84 and the end seal portion 87, and thus the toner may be leaked.

In addition, as illustrated in FIG. 14B, the adhesive sealing member 84 is adhered to the seating surface in a state of being compressed and deformed between the cleaning frame 71 and the end seal portion 87 while allowing the end seal portion 87 to be bent in a G direction (direction vertical to the rotational axis direction). At this time, since the end seal portion 87 has a shape which is obliquely protruded from the adhesive seating surface 88, the sealing member 84 is adhered to the seating surface in a state of being bent in the G direction.

Next, the details of the end seal portion 87 will be described using FIG. 1 and FIGS. 13A to 15C. As illustrated in FIGS. 1 and 13A, the end seal portion 87 is a portion extending in an intersection direction, which intersects the rotational axis direction, at the end in the rotational axis direction of the elastomer member 86. The end seal portion 87 is deformed to fill a gap formed between the cleaning frame 71, an end in the rotational axis direction of the sheet member 85, and the adhesive sealing member 84 when being compressed.

As illustrated in FIG. 13B, the end seal portion 87 is provided to have an inclined surface 87*e* and to be protruded from the adhesive seating surface 88. The inclined surface 87*e* has an inclined shape, and includes a G-direction component on a surface which faces the outside of the cleaning frame 71 and is parallel to the adhesive seating surface 88 of the adhesive sealing member 84. More specifically, in this embodiment, the inclined surface 87*e* including the G-direction component on a surface which is parallel to the longitudinal direction C and faces the outside of the cleaning frame 71 was provided. By such a shape, when the adhesive sealing member 84 is adhered to the adhesive seating surface 88 in the vertical direction, the end seal portion 87 can be bent in the G direction. In this embodiment, the end seal portion 87 is bent in the G direction, but is not limited thereto. A shape of an inclined surface including a component of a direction opposite to the G direction may be provided, when a worker wishes to bend the end seal portion 87 to the inside of the cleaning frame 71 which is the direction opposite to the G direction, with respect to the adhesive seating surface 88.

Then, as illustrated in FIG. 1, a surface of the end seal portion 87 facing the flexible sheet member 85 has the inclined surface 87*a* which is protruded further than the elastomer member 86 from the welding portion 86*a* of the elastomer member 86 toward a tip of the end seal portion 87. However, the end seal portion 87 may be configured to have a protruding portion 87*d* protruded further than the adhesive seating surface 88 of the elastomer member 86 in the state of being compressed between the cleaning frame 71 and the adhesive sealing member 84, without being limited thereto. Then, during the attachment of the sheet member 85, the protruding portion 87*d* may be configured to be deformed to fill the gap formed between the cleaning frame 71 and the sheet member 85.

Here, as illustrated in FIGS. 15A and 15B, a boundary point between the welding portion 86*a* and the end seal portion 87 in the state where the end seal portion 87 is compressed by the adhesive sealing member 84 is referred to as an incline starting point Q of the end seal portion 87. In addition, as illustrated in FIGS. 14A and 14B, reference numeral N indicates an upstream ridge line of the adhesive sealing member 84 in a rotational direction R of the drum 62 under no-load condition (state of not being compressed). In FIGS. 14A and 14B, broken lines indicate adhesion positions of the end seal portion 87. In addition, as illustrated in FIG. 1, reference numeral S indicates a thickness of the adhesive sealing member 84 under the no-load condition (state of not being compressed).

Then, as illustrated in FIG. 1, reference numeral $\gamma$ indicates an angle formed by a connecting line of the incline starting point Q with the upstream ridge line N of the end seal portion 87 in the rotational direction R of the drum and the welding portion 86*a* of the elastomer member 86. In addition, reference numeral $\theta$ indicates an inclination angle of the inclined surface 87*a* with respect to the welding portion 86*a*. In this embodiment, a value of the inclination angle $\theta$ was set to satisfy the relation of $\gamma>\theta$. By the value $\theta$ set as described above, a crushed amount X3 of the adhesive sealing member 84 during the assembly of the drum 62 is larger than a projection amount X2 (amount of the inclined surface 87*a* crushed into the flexible sheet member 85 during the assembly of the drum 62) of the inclined surface 87*a*. Therefore, it is possible to reliably prevent the leakage of the toner.

In contrast, as illustrated in FIGS. 16, 17A, and 17B, in the comparative example, an end seal portion 187 not having the inclined surface 87*a* is employed instead of the end seal portion 87 of this embodiment. In this way, in a configuration not having the inclined surface 87*a*, a surface 187*a* of the end seal portion 187 facing the flexible sheet member 85 is depressed more than a welding portion 186*a* of the flexible sheet member 85 at the time of adhesion of the adhesive sealing member 84. That is, the protruding portion 87*d* of this embodiment was not be provided. In this state, when the flexible sheet member 85 and the drum 62 are assembled, a gap Y1 is formed by the sheet member 85, the adhesive sealing member 84, and the end seal portion 187 (see FIG. 17B). Accordingly, the leakage of the toner occurs through the gap Y1.

In the configuration according to this embodiment having the protruding portion 87*d* having the inclined surface 87*a* illustrated in FIG. 15C, the end seal portion 87 is compressed between the cleaning frame 71 and the sheet member 85, thereby causing the deformation of the protruding portion 87*d*. Then, the deformed protruding portion 87*d* fills the gap Y1 formed between the sheet member 85 and the end seal portion 87, so that it is possible to reliably suppress the leakage of the toner.

In addition, the end seal portion 87 has a circular arc curved surface 87*b* at a tip in an extending direction (intersection direction intersecting the rotational axis direction). When viewed from the longitudinal direction of the curved surface 87*b*, a width X1 is larger than a protrusion amount X2 of the end seal portion 87 from the welding portion 86*a*. In addition, a tail end U of the curved surface 87*b* is set to be located between the regulating surface 72*e* of the flexible sheet member 85 and the adhesive seating surface 88 of the adhesive sealing member 84. At the time of the adhesion of the adhesive sealing member 84, the compressed end seal portion 87 will be restored to the state before the adhesive sealing member 84 is adhered, due to the elasticity. At this time, since the curved surface 87*b* of the end seal portion 87 slides down an end-seal end face 84*a*, the end seal portion 87 can be restored to its original shape. As a result, the end seal portion 87 has a shape which becomes gradually narrow from the cleaning frame 71 toward a portion contacting with the flexible sheet member 85.

In contrast, in the case of not having the curved surface 87*b* as illustrated in FIGS. 16, 17A, and 17B, the tip 187*b* of the end seal portion 187 is caught on the end face 84*a* of the adhesive sealing member 84 at the time of the adhesion of the adhesive sealing member 84 and thus the end seal portion 187 does not return to its original shape (see FIG. 17A). In this state, when the flexible sheet member 85 and the drum 62 are assembled, a gap Y2 is formed by the sheet member 85, the adhesive sealing member 84, and the end seal portion 187 (see FIG. 17B). Accordingly, the leakage of the toner occurs through the gap Y2. Meanwhile, as illustrated in FIG. 15C, since the end seal portion 87 is restored to its original shape by the circular arc curved surface 87*b*, the gap Y2 can be filled when the drum 62 is assembled and thus the end seal portion 87 is compressed by the sheet member 85. When the tail end U of the curved surface is located between the regulating surface 72*e* of the flexible sheet member 85 and the adhesive seating surface 88 of the adhesive sealing member 84, the radius of the circular arc of the curved surface 87*b* may be small. In addition, the configuration of the end seal portion 87 is not limited to this embodiment as long as the tip of the end seal portion 87 has a round-shaped corner and slides down the end-seal end face 84*a* when being compressed, so that the end seal portion 87 can be restored to its original shape.

Furthermore, a base portion on a side to be molded in the cleaning frame 71 of the end seal portion 87 of this embodiment is provided with a base surface 87*c* inclined toward a direction of the adhesive sealing member 84. In contrast, when there is no base surface 87*c* as illustrated in FIGS. 16, 17A, and 17B, a gap Y3 is formed by the cleaning frame 71, the adhesive sealing member 84, and the end seal portion 87 (see FIGS. 17A and 17B) at the time of the adhesion of the adhesive sealing member 84. Therefore, the leakage of the toner occurs through the gap Y3. In the configuration of this embodiment, the base surface 87*c* can fill the gap Y3 which can be formed at the time of the adhesion of the adhesive sealing member 84 (see FIG. 15C).

With the above configuration, it is possible to prevent the toner from being leaked from the gaps Y1, Y2, and Y3 formed by the cleaning frame 71, the adhesive sealing member 84, the flexible sheet member 85, and the end seal portion 87.

As described above, since this embodiment includes the end seal portion 87 provided in the elastomer member 86, it is possible to suppress the leakage of the toner T from the end of the drum 62 without applying a filling member as in the prior art. Specifically, the end seal portion 87 is in the state of being compressed and deformed between the cleaning frame 71 and the adhesive sealing member 84 and between the cleaning frame 71 and the sheet member 85. As a result, it is possible to fill the gaps formed between the cleaning frame 71, the adhesive sealing member 84, and the sheet member 85. More specifically, the end seal portion 87 includes the protruding portion 87*d* having the inclined surface 87*a*, and the protruding portion 87*d* can be deformed to fill the gap formed between the cleaning frame 71 and the sheet member 85 when the end seal portion 87 is compressed.

In addition, since the end seal portion 87 is injection-molded into the cleaning frame 71 together with the elastomer member 86 for tightly securing the sheet member 85, a filling port is not required to be provided separately in the cleaning frame 71 so as to form the end seal portion 87. In addition, the sheet member 85 is welded on the cleaning frame 71 by the melting of the elastomer member 86, and thus there is no need to use the double-sided tape. Accordingly, there is no process of adhering the double-sided tape with high accuracy which has been required to reduce the gaps formed by the frame, the adhesive sealing member, and the flexible sheet member, so that is possible to easily prepare.

In this embodiment, although the seal configuration at the end of the drum 62 of the cleaning unit 60 is described, the seal configuration is also applicable to the end of the developing roller 32 of the developing unit 20. That is, in the end of the developing roller 32 as the rotating member of the developing unit 20 serving as the developer container, it is also applicable to a configuration in which the toner is prevented from being leaked from the gap formed between the second sealing member 56 as the adhesive sealing member and the fourth sealing member 58 as the sheet member. In this case, a method of molding the elastomer member 86 according to this embodiment into the cleaning frame 71 is also applicable to the molding of elastomer member into the developer container 23.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-019315, filed on Feb. 4, 2014, which is hereby incorporated by reference herein in its entirety.

What is claimed is:

1. A developer container comprising: a frame that is configured to accommodate developer;

a rotating member that is rotatably supported by the frame;

a sheet member that is elongated along a rotational axis direction of the rotating member, wherein, in a short-length direction crossing the rotational axis direction, one end of the sheet member comes into contact with the rotating member along the rotational axis direction, and another end of the sheet member is fixed to the frame;

a resin formed portion, elongated along the rotational axis direction, that is integrally formed with the frame so as to include a surface where the sheet member is fixed; and an end sealing member that is fixed to the frame at an end in the rotational axis direction so as to be side by side with the resin formed portion in the short-length direction, and is compressed between the frame and the rotating member, wherein the resin formed portion includes an extending portion that extends to the end sealing member in the short-length direction, wherein the extending portion includes a protruding portion that is more projected so as to be more away from the frame than the surface with respect to a direction orthogonal to both the rotational axis direction and the short-length direction when the sheet member and the rotating member are not mounted to the frame, and wherein the protruding portion is compressed between the frame and the sheet member when the sheet member and the rotating member are mounted to the frame.

2. The developer container according to claim 1, wherein, with respect to the direction orthogonal to both the rotational axis direction and the short-length direction, a projection amount of the protruding portion from the surface becomes gradually larger going away from the surface before attaching the rotating member and the sheet member.

3. The developer container according to claim 1, wherein the frame has a depressed portion that extends in the rotational axis direction, and a part of the resin formed portion is formed into the depressed portion.

4. The developer container according to claim 3, wherein the resin material is thermoplastic resin.

5. The developer container according to claim 1, wherein the rotating member is an image bearing member, and wherein the frame accommodates developer removed from the image bearing member.

6. The developer container according to claim 1, wherein the rotating member is a developer carrier carrying developer to be used for developing a latent image formed on an image bearing member, and wherein the frame accommodates the developer to be used for developing the latent image.

7. The developer container according to claim 1, wherein the resin formed portion is formed by injection molding of a resin material.

8. A cartridge that can be detachably attached to an apparatus main body of an image-forming apparatus in which an image is formed on a recording material, the cartridge comprising:

a developer container including:

a frame that is configured to accommodate developer;

a rotating member that is rotatably supported by the frame;

a blade contacting the rotating member;

a sheet member that is elongated along a rotational axis direction of the rotating member, wherein, in a short-length direction crossing the rotational axis direction, one end of the sheet member comes into contact with the rotating member along the rotational axis direction, and another end of the sheet member is fixed to the frame;

a resin formed portion, elongated along the rotational axis direction, that is integrally formed with the frame so as to include a surface where the sheet member is fixed; and an end sealing member that is fixed to the frame at an end in the rotational axis direction so as to be side by side with the resin formed portion in the short-length direction, and is compressed between the frame and the rotating member, wherein the resin formed portion includes an extending portion that extends to the end sealing member in the short-length direction, wherein the extending portion includes a protruding portion that is more projected so as to be more away from the frame than the surface with respect to a direction orthogonal to both the rotational axis direction and the short-length direction when the sheet member and the rotating member are not mounted to the frame, and wherein the protruding portion is compressed between the frame and the sheet member when the sheet member and the rotating member are mounted to the frame.

9. The cartridge according to claim 8, wherein, with respect to the direction orthogonal to both the rotational axis direction and the short-length direction, a projection amount of the protruding portion from the surface becomes gradually larger going away from the surface before attaching the rotating member and the sheet member.

10. The cartridge according to claim 8, wherein the resin formed portion is formed by injection molding of a resin material.

11. The cartridge according to claim 10, wherein the frame has a depressed portion that extends in the rotational axis direction, and a part of the resin formed portion is formed into the depressed portion.

12. The cartridge according to claim 11, wherein the resin material is thermoplastic resin.

13. An image-forming apparatus for forming an image on a recording material, the image-forming apparatus comprising:

a developer container including:

a frame that is configured to accommodate developer;

a rotating member that is rotatably supported by the frame;

a blade contacting the rotating member;

a sheet member that is elongated along a rotational axis direction of the rotating member, wherein, in a short-length direction crossing the rotational axis direction, one end of the sheet member comes into contact with the rotating member along the rotational axis direction, and another end of the sheet member is fixed to the frame;

a resin formed portion, elongated along a rotational axis direction, that is integrally formed with the frame so as to include a surface where the sheet member is fixed; and an end sealing member that is fixed to the frame at an end in the rotational axis direction so as to be side by side with the resin formed portion in the short-length direction, and is compressed between the frame and the rotating member, wherein the resin formed portion includes an extending portion that extends to the end sealing member in the short-length direction, wherein the extending portion includes a protruding portion that is more projected so as to be more away from the frame than the surface with respect to a direction orthogonal to both the rotational axis direction and the short-length direction when the sheet member and the rotating member are not mounted to the frame, and wherein the protruding portion is compressed between the frame and the sheet member when the sheet member and the rotating member are mounted to the frame.

14. The image-forming apparatus according to claim 13, wherein, with respect to the direction orthogonal to both the rotational axis direction and the short-length direction, a projection amount of the protruding portion from the surface becomes gradually larger going away from the surface before attaching the rotating member and the sheet member.

15. The image-forming apparatus according to claim 13, wherein the frame has a depressed portion that extends in the rotational axis direction, and a part of the resin formed portion is formed into the depressed portion.

16. The image-forming apparatus according to claim 15, wherein the resin material is thermoplastic resin.

17. The image forming apparatus according to claim 13, wherein the resin formed portion is formed by injection molding of a resin material.

18. A developer container comprising:

a frame that is configured to accommodate developer, the frame extending in a longitudinal direction;

a resin formed portion that is integrally formed with the frame;

a sheet member that is elongated along the longitudinal direction wherein one end side of the sheet member in a short-length direction crossing the longitudinal direction is fixed to a surface of the resin formed portion; and an end sealing member that is fixed to the frame at an end in the longitudinal direction so as to be side by side with the resin formed portion in the short-length direction, wherein the resin formed portion includes an extending portion that extends to the end sealing member in the short-length direction, wherein the extending portion includes a protruding portion that is more projected than the surface with respect to a direction orthogonal to both the longitudinal direction and the short-length direction when the sheet member is not mounted to the frame, and wherein the protruding portion comes into contact with the sheet member when the sheet member is mounted to the frame.

19. The developer container according to claim 18, wherein, with respect to the direction orthogonal to both the longitudinal direction and the direction short-length, a projection amount of the protruding portion from the surface becomes gradually larger going away from the surface before attaching the sheet member.

20. The developer container according to claim 18, wherein the resin formed portion is formed by injection molding of a resin material.

21. The developer container according to claim 18, wherein the frame has a depressed portion that extends in the longitudinal direction, and a part of the resin formed portion is formed into the depressed portion.

22. The developer container according to claim 20, wherein the resin material is thermoplastic resin.

* * * * *